US005194361A

United States Patent [19]

Taguchi

[11] Patent Number: 5,194,361

[45] Date of Patent: Mar. 16, 1993

[54] DIFFUSION TRANSFER COLOR PHOTOSENSITIVE MATERIAL WITH QUATERNARY AMMONIUM MORDANT AND COUNTER ION

[75] Inventor: Toshiki Taguchi, Kanagawa, Japan

[73] Assignee: Fuji Photo Film Co., Ltd., Kanagawa, Japan

[21] Appl. No.: 700,984

[22] Filed: May 16, 1991

[30] Foreign Application Priority Data

May 16, 1990 [JP] Japan ..... 2-125849

[51] Int. Cl.[5] ..... G03C 5/54

[52] U.S. Cl. ..... 430/203; 430/213; 430/214; 430/215; 430/217; 430/371; 430/536; 430/559; 430/941

[58] Field of Search ..... 430/203, 213, 214, 215, 430/217, 371, 941, 559, 536

[56] References Cited

U.S. PATENT DOCUMENTS

| | | | |
|---|---|---|---|
| 3,930,864 | 1/1976 | Abel et al. | 430/213 |
| 4,450,224 | 5/1984 | Klein et al. | 430/213 |
| 4,563,411 | 1/1986 | Bronstein-Bonte | 430/213 |
| 4,720,446 | 1/1988 | Toriuchi et al. | 430/213 |
| 4,721,666 | 1/1988 | Yamanouchi et al. | 430/213 |
| 5,023,162 | 6/1991 | Yamanouchi et al. | 430/213 |
| 5,112,720 | 5/1992 | Karino et al. | 430/213 |

FOREIGN PATENT DOCUMENTS

| | | |
|---|---|---|
| 0144059 | 6/1985 | European Pat. Off. . |
| 2728844 | 12/1977 | Fed. Rep. of Germany . |

*Primary Examiner*—Richard L. Schilling

*Attorney, Agent, or Firm*—Sughrue, Mion, Zinn, Macpeak & Seas

[57] ABSTRACT

A diffusion transfer color photosensitive material is disclosed, comprising a support having thereon at least light-sensitive silver halides, binders and nondiffusible dye-providing compounds capable of releasing or forming a diffusible dye, corresponding to or counter-corresponding to the progress of conversion of the siliver halide into silver through reductive reaction, which contains as a trapping agent at least one compound represented by the following formula (I) to prevent the generation and/or the transfer of dyes in the white area without causing the lowering of image density:

$$-(A)_p-(B)_q- \quad \text{(I)}$$

[wherein A represents at least one vinyl monomer unit containing a quaternary ammonium ion associated therewith a counter ion at least 50 mol % of which is constituted by an anion represented by the following formula (II):

$$R-X^- \quad \text{(II)}$$

(wherein $X^-$ represents $SO_3^-$ and/or $COO^-$, and R represents a substituted or unsubstituted alkyl, aryl, alkoxy, aryloxy or heterocyclyl group); B represents at least one vinyl monomer unit containing no quaternary ammonium salt moiety; p amounts to 2 to 100 mol % in all; and q amounts to 0 to 98 mol % in all].

3 Claims, No Drawings

DIFFUSION TRANSFER COLOR PHOTOSENSITIVE MATERIAL WITH QUATERNARY AMMONIUM MORDANT AND COUNTER ION

FIELD OF THE INVENTION

This invention relates to a diffusion transfer color photosensitive material and, more particularly, to a diffusion transfer photosensitive material which is excellent in fresh storage stability and can produce a color image of high maximum density and low stain density.

BACKGROUND OF THE INVENTION

The photography using silver halides has been most prevailingly employed until now since ,it is superior in photographic characteristics, e.g., photographic speed, facility of gradation control, etc., to other photographic processes such as electrophotography, diazo photography and so on. In recent years, there have been developed the arts of forming images simply and rapidly by adopting a dry process utilizing a heat-applying or like means instead of the conventional wet processes using a developing solution or the like as a processing method for forming images in photosensitive materials using silver halides.

In the above-described arts, heat developable photosensitive materials are well-known, and such materials and processes therefor are described, e.g., in *Shashin Kogaku no Kiso* (which means "bases of photographic engineering"), given in the volume entitled "Hi-gin-en shashin" (which means non-silver photography) on pages 242–255, published by Corona Co. (1982).

Many methods for obtaining color images through heat development have been proposed.

For instance, there has been proposed a method of forming color images by binding couplers to oxidation products of developing agents, e.g., in U.S. Pat. Nos. 3,531,286, 3,761,270 and 4,021,240, Belgian Patent 802,519, *Research Disclosure* (abbreviated as RD, hereinafter), pp. 31–32 (September 1975), and so on.

However, in heat developable photosensitive materials of the kind which produce color images in accordance with the above-cited method, silver halides are left even after the image formation, because such materials are of a nonfixed type. Therefore, they possess a serious defect that the white part thereof is stained gradually upon exposure to intense light or during long-range storage. In addition, it generally takes a relatively long time to complete the development in the above-cited methods and, what is worse, the obtained images suffer from a disadvantage of having high fog density and low image density.

For the purpose of obviating those defects, another method has been proposed, which comprises forming or releasing imagewise diffusible dyes by heating, and transferring these diffusible dyes into an image receiving material, which contains a mordant, with the aid of a solvent such as water or the like [as disclosed, e.g., in U.S. Pat. Nos. 4,500,626, 4,483,914, 4,503,147 and 4,559,902, JP-A-59-165054 (the term "JP-A" as used herein means an unexamined published Japanese patent application)].

In the above method, a development temperature which can be adopted is still high, and the storage stability of the photosensitive materials cannot be said to be satisfactorily high. Thereupon, still another method in which transfer of dyes are carried out through heat development in the presence of a base or a precursor thereof and a trace amount of water with the intention of promotion of development, lowering of development temperature and simplification of processing operations is disclosed, e.g., in JP-A-59-218443, JP-A-61-238056, European Patent 210,660A2, and so on.

On the other hand, many methods for forming positive color images through heat development have been proposed.

For instance, U.S. Pat. No. 4,559,290 discloses a method in which so-called DRR compounds are incorporated in a photosensitive material in the oxidized form devoid of an ability to release dyes, and reduced by a reducing agent which is introduced into the photosensitive material, optionally in the form of precursor, and remains unoxidized upon heat development which functions so as to oxidize the reducing agent or its precursor in proportion to the amount of exposed silver halide, resulting in the release of diffusible dyes. In addition, European Patent 220,746A and Kokai Giho 87-6299 (Vol. 12, No. 22) disclose heat developable color photosensitive materials which utilize compounds capable of releasing diffusible dyes by the reductive cleavage of an N—X bond (wherein X represents an oxygen, nitrogen or sulfur atom) as compounds capable of releasing diffusible dyes by a similar mechanism to above. Especially in color photosensitive materials of the type which form images through the diffusion transfer of dyes among the above-cited ones, a discrimination quality of the images depends on the extent to which generation and transfer of dyes in the white part are inhibited.

However, the white part of diffusion transfer color photosensitive materials which have been proposed up to the present cannot attain the level of that of commercially available color print materials. As a means of making an improvement in the white part, capturing surplus transferred dyes is thought of. As for the art thereof, various ideas have been proposed until now. For instance, the art of incorporating a mordant of quaternary salt type in a constituent layer of a diffusion transfer photosensitive material, or providing a diffusion transfer photosensitive material with a layer of said mordant is disclosed, e.g., in U.S. Pat. Nos. 3,939,864 and 3,958,995, RD pp. 162 (October 1977), JP-A-52-148123, JP-B-59-14738 (the term "JP-B" as used herein means an "examined Japanese patent publication"), and so on. In addition, the art of incorporating dispersions of physical and chemical adsorbents into photosensitive materials is disclosed in JP-A-2-44356.

As a result of examining and comparing various compounds having an ability to capture dyes (which are called a trapping agent, hereinafter), the present inventor has already found that quaternary ammonium salt polymers used as a mordant in conventional diffusion transfer systems have excellent ability to trap dyes. However, quaternary salt polymers condense in the presence of anionic surface active agents used as emulsifying and coating aids in the field concerned and/or a viscosity increasing agent to result in formation of coarse granules, and eventually in generation of precipitates. Such being the case, adding quaternary salt polymers as they are to a coated layer as a trapping agent has turned out to be difficult. Further, it has found that when quaternary salt polymers are incorporated as they are in photosensitive materials wherein silver halides are present, many of them exert bad influences on the development reaction of silver halides to no small extent, because they contain halide ions as counter anions. Furthermore, it has turned out that when a layer (a capturing and mordanting layer) is made up of a quaternary salt polymer alone without using any anionic coating aids with the intention of avoiding the agglutination of quaternary salt polymers, an increase in thickness is caused in photosensitive materials of the kind which form dye images through diffusion transfer, resulting in lowering of maximum density.

SUMMARY OF THE INVENTION

As a result of extensive investigations on settlement of the above-described questions and utilization of quaternary salt polymers as trapping agent, it has now been found that the above-described purposes can be accomplished by properly replacing conventional counter anions of a quaternary salt polymer.

That is, an object of this invention is to provide a diffusion transfer color photosensitive material which has a smooth and uniform surface, and ensures high image density and low stain density.

The above-described object of this invention is attained with a diffusion transfer color photosensitive material comprising a support having thereon at least light-sensitive silver halides, binders and nondiffusible dye-providing compounds capable of releasing or forming a diffusible dye, corresponding to or counter-corresponding to the progress of conversion of the silver halides into silver through reductive reaction, which further has at least one compound represented by the following formula (I):

$$-(A)_p-(B)_q- \qquad (I)$$

[wherein A represents at least one vinyl monomer unit containing a quaternary ammonium ion associated therewith a counter ion at least 50 mo % of which is constituted by an anion represented by the following formula (II):

$$R-X^- \qquad (II)$$

(wherein $X^-$ represents $SO_3^-$ and/or $COO^-$; and R represents a substituted or unsubstituted alkyl, aryl, alkoxy, aryloxy or heterocyclyl group); B represents at least one vinyl monomer unit containing no quaternary ammonium salt moiety; p amounts to 2 to 100 mol % in all; and q amounts to 0 to 98 mol % in all].

DETAILED DESCRIPTION OF THE INVENTION

It is to be desired that the vinyl monomer unit —(A)— in formula (I) of this invention should be represented specifically by formula (III):

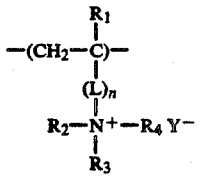

(III)

(wherein $R_1$ represents a hydrogen atom or a lower alkyl group containing 1 to 6 carbon atoms; L represents a divalent linkage group containing 1 to 20 carbon atoms; $R_2$, $R_3$ and $R_4$ may be the same or different and each is an alkyl group containing 1 to 12 carbon atoms or an aralkyl group containing 7 to 20 carbon atoms; $R_1$, $R_2$, $R_3$ and/or $R_4$ may combine with each other to form a cyclic structure together with the nitrogen atom; Y represents a monovalent anion; and n is 0 or 1).

More specifically, $R_1$ represents a hydrogen atom or a lower alkyl group containing 1 to 6 carbon atoms, e.g., methyl, ethyl, n-propyl, n-butyl, n-amyl, n-hexyl. In particular, a hydrogen atom or methyl group is preferred as $R_1$ L represents a divalent linkage group containing 1 to 20 carbon atoms, such as an alkylene group (e.g., methylene, ethylene, trimethylene, hexamethylene), a phenylene group (e.g., o-phenylene, p-phenylene, m-phenylene), an arylene-alkylene group [e.g.,

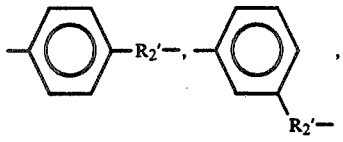

(wherein $R_2'$ represents an alkylene group containing 1 to 12 carbon atoms)], $—CO_2—$, $—CO_2—R_3'—$ (wherein $R_3'$ represents an alkylene group, a phenylene group, or an arylenealkylene group), —COHN—$R_3'$— (wherein $R_3'$ has the same meaning as described above), or

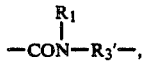

(wherein $R_1$ and $R_3'$ have the same meanings as described above, respectively). Divalent linkage groups preferred in particular as L include

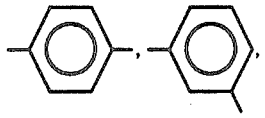

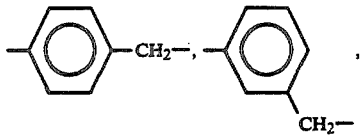

$—CO_2CH_2CH_2—$, $—CO_2CH_2CH_2CH_2—$, $—CONHCH_2—$, $—CONHCH_2CH_2—$, and $—CONHCH_2CH_2CH_2—$.

$R_2$, $R_3$ and $R_4$ may be the same or different and each is an alkyl group-containing 1 to 12 carbon atoms (including unsubstituted ones such as methyl, ethyl, n-propyl, n-butyl, n-amyl, n-hexyl, n-octyl, 2-ethylhexyl, n-nonyl, n-decyl, n-dodecyl, and substituted ones such as methoxyethyl, 3-cyanopropyl, ethoxycarbonylethyl, acetoxyethyl, 2-butenyl, etc.), or an aralkyl group containing 7 to 20 carbon atoms (including unsubstituted ones such as benzyl, phenethyl, diphenylmethyl, naphthylmethy, and substituted ones such as 4-methylbenzyl, 4-isopropylbenzyl, 4-methoxybenzyl, 4-(4-methoxyphenyl)benzyl, 3-chlorobenzyl).

Examples of a cyclic structure which is completed by combining the nitrogen atom, $R_2$, $R_3$, and/or $R_4$ with one another include

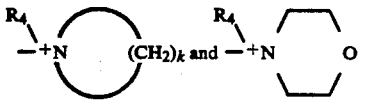

(wherein $R_4$ has the same meaning as described above, and k represents an integer from 4 to 12) in the case where $R_2$ and $R_3$ take part in the ring formation; and further,

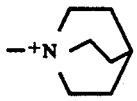

in the case where $R_2$, $R_3$ and $R_4$ all take part in the ring formation.

$Y^-$ represents a monovalent anion, at least 50 mol % of which is an anion represented by formula (II):

$$R-X^- \quad \text{(II)}$$

[wherein $X^-$ represents $SO_3^-$ and/or $COO^-$; and R represents a substituted or unsubstituted alkyl group (e.g., dodecyl, cetyl, hexadecyl, octadecyl), an aryl group (e.g., butylphenyl, ethylphenyl, dodecylphenyl, naphthyl), an alkoxy group (e.g., dodecyloxy, cetyloxy, hexadecyloxy, polyoxyethylene alcohol ethers), an aryloxy group (e.g., butylphenoxy, dodecylphenoxy, naphthoxy), or a heterocyclyl group (e.g., octylpyridyl, dodecylfuryl).

As for the number of carbon atoms contained in R, although it can be chosen from a wide range, it is particularly desirable for more stable introduction of the compound of formula (I) into a coating composition that the number should be at least 10, more preferably within the range of 10 to 40.

Anions represented by $Y^-$, other than those represented by formula (II), can be those chosen from various kinds of monovalent anions. However, they are preferably counter anions, such as $Cl^-$, $Br^-$, as known in JP-B-59-14738, U.S. Pat. No. 3,930,864, and so on.

The other vinyl monomer unit, —(B)—, in formula (I) of this invention includes those containing no quaternary nitrogen atom. In particular, vinyl monomer units bearing no electric charge are preferred over others.

Suitable examples of such a vinyl monomer unit —(B)— include ethylene, propylene, 1-butene, isobutene, styrene, α-methylstyrene, vinyltoluene, monoethylenic unsaturated esters of fatty acids (e.g., vinyl acetate, allyl acetate), monoethylenic unsaturated amides of fatty acids (e.g., N-vinylacetamide, N-vinylpyrrolidone), ethylenic unsaturated mono- or dicarboxylic acid esters (e.g., methyl methacrylate, ethyl acrylate, n-butyl acrylate, n-butyl methacrylate, benzyl acrylate, diethyl maleate, diethyl itaconate), ethylenic unsaturated monocarboxylic acid amides (e.g., acrylamide, dimethylacrylamide, methacrylamide, diacetoneacrylamide, acryloylmorpholine), monoethylenic unsaturated compounds (e.g., acrylonitrile), and dienes (e.g., butadiene, isoprene). Among these vinyl monomers, styrene, ethylenic unsaturated carboxylic acid esters and ethylenic unsaturated carboxylic acid amides are favored over others.

When the polymer containing the monomer units represented by formula (I) as constitutional repeating units is designed for a crosslinked latex, the vinyl monomer unit —(B)— can be one which is free from quaternary ammonium moiety, but contains two or more of copolymerizable unsaturated bonds in a molecule. Specific examples of such a vinyl monomer unit which can be preferably used include divinylbenzene, ethylene glycol dimethacrylate, propylene glycol dimethacrylate, methylenebisacrylamide, ethylene glycol diacrylate, and so on. Among these monomer units, divinylbenzene, ethylene glycol dimethacrylate and ethylene glycol diacrylate are preferred in particular.

—(A)— and/or —(B)— may contain two or more of vinyl monomer units as cited above respectively.

p amounts to from 2 to 100 mol %, preferably from 60 to 98 mol %, in all; and q amounts to from 0 to 98 mol %, preferably from 2 to 40 mol %, in all.

Specific examples of preferable trapping agent polymers which are represented by formula (I) of this invention are illustrated below, dividing them into the polymer part (A) and the counter anion part (B) represented by the general formula (II).

Each of the exemplified polymer parts can be combined with any of the exemplified counter anion parts. For instance, the expression "$A_5B_{10}$" signifies the trapping agent polymer wherein the polymer skeleton part is $A_5$, and at least 50 mol % of the counter anion in the quaternary salt part is $B_{10}$.

Preferred examples of the polymer part A are illustrated below.

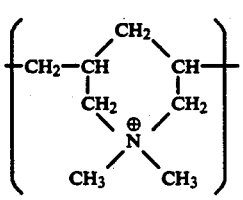

$A_1$

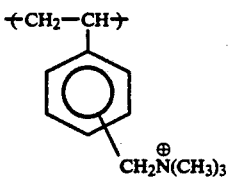

$A_2$

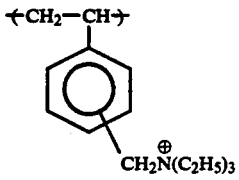

$A_3$

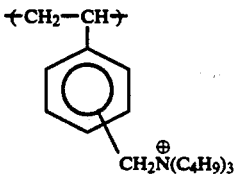

$A_4$

-continued
A5
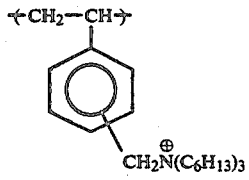
A6
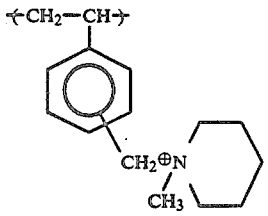
A7
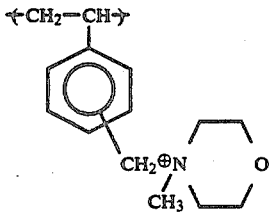
A8
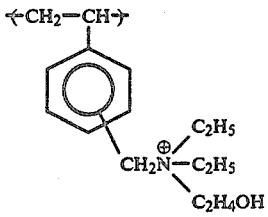
A9
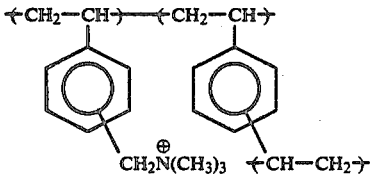
A10
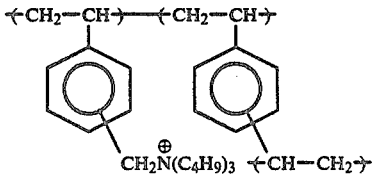
A11
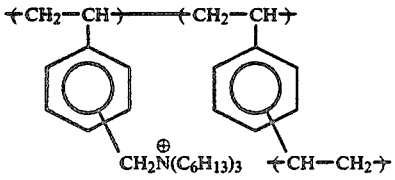
A12
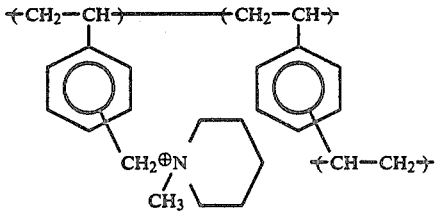
A13
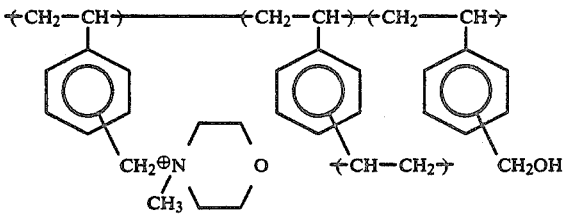
A14
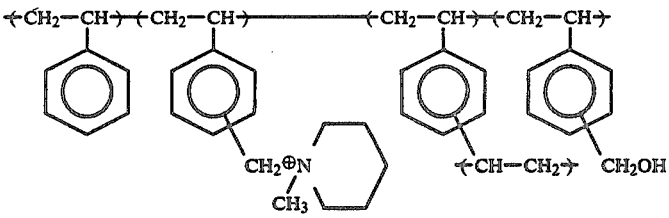
A15
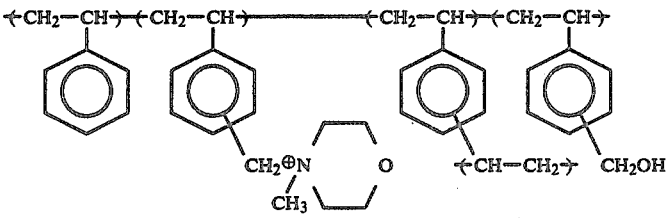

Preferred examples of the counter anion part are illustrated below.
$B_1$
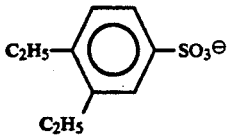
$B_2$
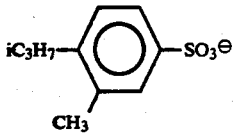
$B_3$
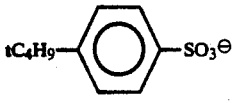
$B_4$
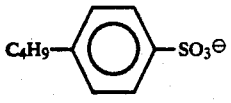
$B_5$
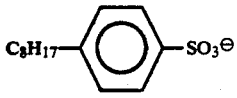
$B_6$
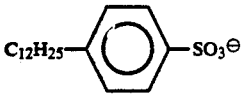
$B_7$
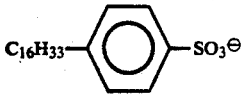
$B_8$
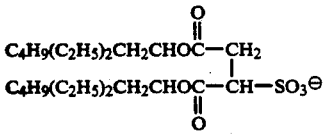
$B_9$
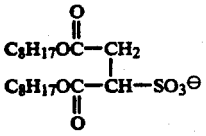
$B_{10}$
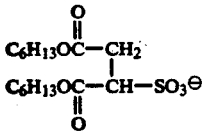
$B_{11}$
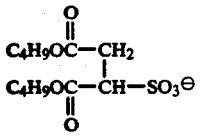
-continued
$B_{12}$
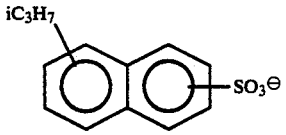
$B_{13}$
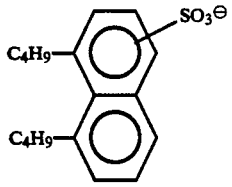
$B_{14}$
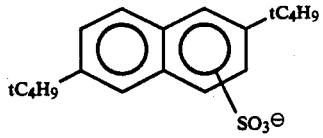
$B_{15}$
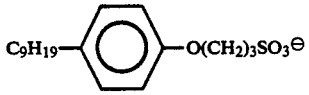
$B_{16}$
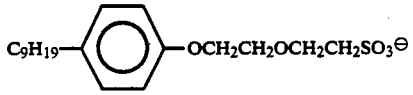
$B_{17}$
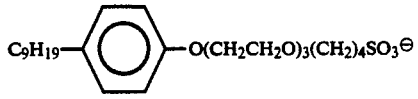
$B_{18}$
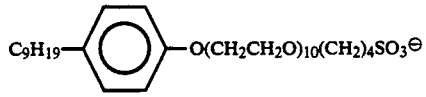
$B_{19}$
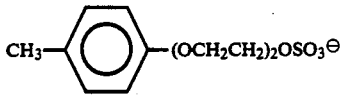
$B_{20}$ $CH_3(OCH_2CH_2)_6OSO_3^{\ominus}$
$B_{21}$ $C_{10}H_{21}OSO_3^{\ominus}$
$B_{22}$ $C_{12}H_{25}OSO_3^{\ominus}$
$B_{23}$ $C_{16}H_{33}OSO_3^{\ominus}$
$B_{24}$ $C_{18}H_{37}OSO_3^{\ominus}$
$B_{25}$
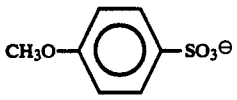
$B_{26}$
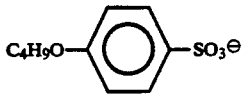
$B_{27}$
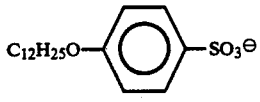

-continued

B28 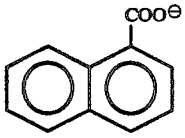

B29 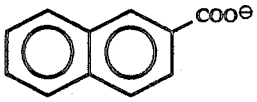

B30 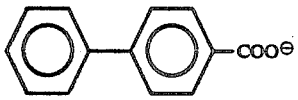

B31 $C_{11}H_{23}COO^{\ominus}$

B32 $C_{15}H_{31}COO^{\ominus}$

B33 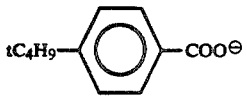

B34 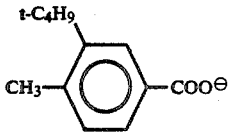

B35 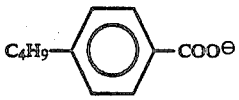

B36 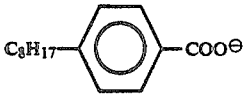

B37 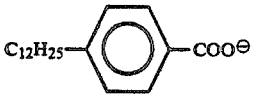

B38 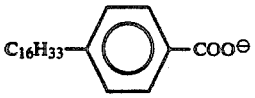

Specific examples of the combination of a polymer part and a counter anion part chosen from the above-illustrated ones, which are preferred as trapping agent polymer, include $A_1B_5$, $A_1B_6$, $A_1B_9$, $A_9B_5$, $A_9B_8$, $A_9B_{10}$, $A_9B_{22}$, $A_{11}B_6$, $A_{11}B_8$, $A_{11}B_{37}$, $A_{11}B_{22}$, $A_{11}B_7$, $A_{11}B_{10}$, $A_{12}B_6$, $A_{12}B_8$, $A_{12}B_{23}$, $A_{13}B_{37}$, $A_{13}B_6$, $A_{13}B_8$, $A_{14}B_5$, $A_{14}B_6$, $A_{14}B_8$, $A_{14}B_{22}$, $A_{15}B_6$, $A_{15}B_8$, and $A_{15}B_{23}$.

It is desirable in respects of photographic characteristics and coating aptitude that the trapping agent polymer which contains as constitutional repeating units the monomer units represented by formula (I) of this invention should have a molecular weight of 10,000,or more. When this trapping agent polymer is used in the form of solution, on the other hand, it is desirable from the standpoint of coating facility that a molecular weight thereof should be 1,000,000 or less, especially 300,000 or less. However, when a vinyl monomer containing two or more of copolymerizable unsaturated bonds in a molecule is used as the vinyl monomer unit —(B)—, the molecular weight of the resulting trapping agent polymer becomes near to infinity. Thus, such a polymer is used in the form of dispersion, taking into account the coating facility.

The trapping agent polymers used in this invention can be obtained by subjecting halogen ions contained as the counter ions in quaternary salt polymers well-known in the field concerned and in ion exchange resins to ion exchange reaction. More specifically, these trapping agent polymers can be prepared in the following manners.

Preparation I

A dispersion of the trapping agent AuBs was prepared in the following manner.

To 200 ml of a polymer latex A represented by the following structural formula (solids content: 11%) was added 600 ml of a 5% solution of a surface active agent (6) having the formula illustrated below. The thus produced aggregates were filtered off, washed and dried. The obtained powder was called a trapping agent $A_{11}B_8$. A 5 g portion of this powder was mixed with 0.2 g of a surface active agent (6), 0.05 g of a surface active agent (8) having the formula illustrated below and 100 ml of a 2% aqueous solution of gelatin, and ground for 30 minutes using glass beads having an average size of 0.75 mm. The glass beads were separated therefrom, and a dispersion of the trapping agent $A_{11}B_8$ was obtained.

Polymer Latex A

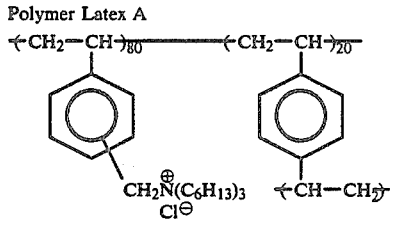

Surface Active Agent (6)

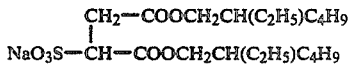

Surface Active Agent (8)

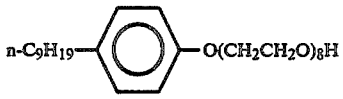

Preparation II

A latex of the trapping agent $A_{14}B_8$ was prepared in the following manner.

A mixture of 108 ml of a polymer latex B represented by the following structural formula (solids content: 13%), 20 g of gelatin and 1,232 ml of water were kept at 40° C with stirring. Thereto, 600 ml of a 5% aqueous solution of the surface active agent (6) was added dropwise over a 10-minute period. The thus prepared suspension was condensed to 500 ml using a ultrafiltration module. After desalting, it was mixed with 1,500 ml of water, and then the same procedure was carried out once again. Thus, the latex of the trapping agent $A_{14}B_8$ was obtained.

Polymer Latex B

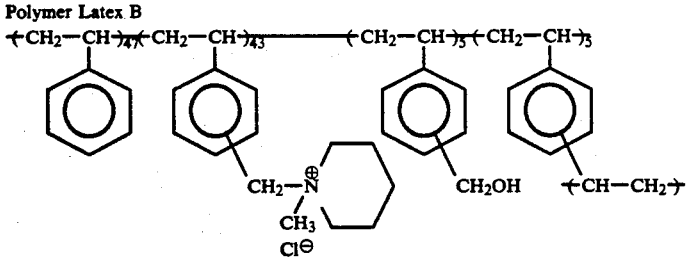

Preparation III

A dispersion of the trapping agent $A_9B_6$ was prepared in the following manner.

A 10% aqueous solution of an acidic surface active agent having the following structural formula was added slowly to 100 g of an aqueous dispersion of the polymer gel represented by the following structural formula (solids content: 20 %, average size: 0.3 μm) with stirring till the pH of the resulting mixture became 6.5. Then, the mixture was transferred into a dissolver, and dispersed for 30 minutes at 6,000 r.p.m., keeping the temperature at 40° C. Thereto, 10 g of lime-processed ossein gelatin was further added, and dispersed for 30 minutes at 3,000 r.p.m., keeping the temperature at 40° C. Thus, the dispersion of the trapping agent $A_9B_6$ was obtained.

Polymer Gel

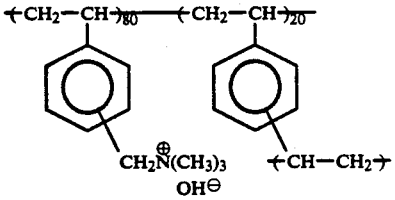

Acidic Surface Active Agent

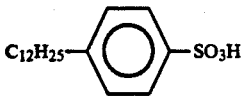

Preparation IV

A latex of the trapping agent $A_{14}B_8$ was prepared in the following manner.

With stirring a mixture of 108 ml of the polymer latex B used in the preparation II, 200 ml of a 10% aqueous solution of the following surface active agent (5) and 1,052 ml of water, 600 ml of a 5% aqueous solution of the surface active agent (6) was added dropwise thereto over a 10-minute period. The thus prepared suspension was condensed and desalted in the same manner as in the preparation II to obtain a latex of the trapping agent $A_{14}B_8$.

Surface Active Agent (5)

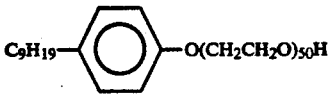

A suitable amount of the polymeric trapping agent added in this invention can be varied over a wide range. Specifically, it ranges from 0.01 to 50 mol %, preferably from 0.1 to 10 mol %, to the whole dye-providing compounds, based on the quaternary salt ion moiety which functions as the active site.

A layer in which the polymeric trapping agent is incorporated may be any constituent layer, including an emulsion layer, an interlayer, a protective layer, a subbing layer and so on.

The photosensitive material of this invention basically has on a support light-sensitive silver halide and diffusible dye-providing compounds, and optionally other additives such as a reducing agent. These essential components are incorporated in the same layer in many cases, but can be added to separate layers, provided that they are in such a condition as to undergo a reaction. For instance, in the case where a diffusible dye-providing compound is colored, it is incorporated into a layer provided under a silver halide emulsion layer to prevent a lowering of sensitivity.

In order to obtain various colors within the range of chromaticity diagram using three primaries, namely yellow, magenta and cyan colors, at least three silver halide emulsion layers which have their respective sensitivities in different spectral regions are used in combination. For example, there can be cited a combination of a blue-sensitive layer, a green-sensitive layer and a red-sensitive layer, and a combination of a green-sensitive layer, a red-sensitive layer and an infrared-sensitive layer. As for the arranging order of these sensitive layers, various known orders may be adopted. These sensitive layers each may be divided into two or more constituent layers, if desired.

The photosensitive material can be provided with various auxiliary layers, including a protective layer, a subbing layer, a yellow filter layer, an antihalation layer, a backing layer, a neutralizing layer, a timing layer, a peel-apart layer and so on.

Silver halides which can be used in this invention may include any of silver chloride, silver bromide, silver iodobromide, silver chlorobromide, silver chloroiodide, and silver chloroiodobromide.

Silver halide emulsions used in this invention may be either those of the kind which form latent image predominantly at the surface of the grains, or those of the kind which mainly form latent image inside the grains. The emulsions of the latter kind are used as direct reversal emulsions when incorporated with a nucleating agent or a fogging agent. Further, such emulsions may be core/shell type ones in which the interior and the surface of the grains are different. As for the grain size distribution, the emulsions may be either monodisperse or polydisperse system. Monodispersed emulsions differing in average grain size may be used in a mixed form. Useful silver halide grains have a mean grain size of from 0.1 μ to 2 μ, particularly preferably from 0.2 μ to 1.5 μ. A crystal habit of the silver halide grains may be any of a cube, an octahedron, a tetradecahedron, and a tablet having a high aspect ratio.

More specifically, any of silver halide emulsions disclosed in U.S. Pat. Nos. 4,500,626 (on column 50) and 4,628,021, RD 17029 (1978), JP-A-62-253159, and so on can be used.

The silver halide emulsions, though may be used in a chemically non-ripened condition, are usually subjected to chemical sensitization. For the chemical sensitization, a sulfur sensitization method, a reduction sensitization method, a noble metal sensitization method and a selenium sensitization method, which are known in the field of emulsions for conventional type photosensitive materials, can be employed independently or in combination thereof. Such chemical sensitization methods can be carried out in the presence of a nitrogen-containing heterocyclic compound (cf. JP-A-62-253159).

A suitable coverage of light-sensitive silver halides used in this invention ranges from 1 mg/m$^2$ to 10 g/m$^2$, based on silver.

Silver halides used in this invention may be spectrally sensitized using methine dyes or other dyes. Suitable spectral sensitizing dyes which can be employed include cyanine dyes, merocyanine dyes, complex cyanine dyes, complex merocyanine dyes, holopolar cyanine dyes, hemicyanine dyes, styryl dyes and hemioxonol dyes.

Specifically, sensitizing dyes disclosed in U.S. Pat. No. 4,617,257, JP-A-59-180550, JP-A-60-140335, RD 17029, pp. 23–12 (1978), and so on can be given as examples.

These sensitizing dyes may be employed individually or in combination. Combinations of sensitizing dyes are often used for the purpose of supersensitization.

Compounds which can exhibit a supersensitizing effect in combination with a certain sensitizing dye although they themselves do not spectrally sensitize silver halide emulsions or do not absorb light in the visible region may be incorporated into the silver halide emulsions (e.g., those disclosed in U.S. Pat. No. 3,615,641, JP-A-63-23145, and so on).

These sensitizing dyes may be added to emulsions during, before or after chemical sensitization, or before or after the nucleation of silver halide grains following the embodiments in U.S. Pat. Nos. 4,183,756 and 4,225,666. A suitable amount of sensitizing dyes added are generally in the order of from $10^{-8}$ to $10^{-2}$ mole per mole of silver halide.

The term "diffusible dye-providing compounds" refers to the compounds of the kind which form or release a diffusible dye, corresponding or counter-corresponding to the progress of reduction from silver ion to silver. Such compounds are abbreviated as "dye-providing compounds", hereinafter.

There are many examples of dye-providing compounds which can be used in this invention; firstly, compounds capable of forming dyes through oxidative coupling reaction (couplers) can be cited. Such couplers, though may be either four-equivalent or two-equivalent ones, are preferably those of two-equivalent type which contain a nondiffusible group as a split-off group and form a diffusible dye through oxidative coupling reaction. Such a nondiffusible group may assume a form of polymer chain. Concrete examples of color developers and couplers are described in detail, e.g., in T. H. James, *The Theory of The Photographic Process*, 4th edition, pp. 291–334 and pp. 354–361, JP-A-58-123533, JP-A-58-149046, JP-A-58-149047, JP-A-59-111148, JP-A-59-124399, JP-A-59-174835, JP-A-59-231539, JP-A-59-231540, JP-A-60-2950, JP-A-60-2951, JP-A-60-14242, JP-A-60-23474, JP-A-60-66249, and so on.

As examples of another type of dye-providing compounds, compounds having such a function as to release imagewise a diffusible dye or to become imagewise diffusible can be given. The compounds of this type can be represented by the following formula [LI]:

$$(\text{Dye}—\text{Y})_n—\text{Z} \qquad [\text{LI}]$$

(wherein Dye represents a dye moiety, a temporarily blue-shifted dye moiety, or a dye precursor moiety; Y represents a bond or a linkage group; Z represents a group having such a property that corresponding or counter-corresponding to latent image distribution in a light-sensitive silver salt, it can cause a change in diffusibility of the compound represented by $(\text{Dye}—\text{Y})_n—\text{Z}$, or can release the moiety Dye to produce a difference between the diffusibility of the released Dye and that of the compound $(\text{Dye}—\text{Y})_n—\text{Z}$; and n represents 1 or 2, and when n is 2, two (Dye—Y)'s may be the same or different).

Specific examples of dye-providing compounds represented by formula [LI]can be described in detail, dividing them into the following classes from (1) to (5). Additionally, the compounds belonging to the following classes from (1) to (3) form diffusible dye image, counter-corresponding to the distribution of developed silver halide (positive dye image) and, on the other hand, those belonging to the classes (4) and (5) form diffusible dye image corresponding to the distribution of developed silver halide (negative dye image).

(1) Developer dyes in which a hydroquinone type developing agent and a dye moiety are connected with each other, as disclosed in U.S. Pat. Nos. 3,134,764, 3,362,819, 3,597,200, 3,544,545 and 3,482,972, and so on. These developer dyes are diffusible under an alkaline condition, but become nondiffusible by the reaction with silver halide.

(2) Nondiffusible compounds which can release a diffusible dye under an alkaline condition, but lose that ability when undergo the reaction with silver halide. As examples of such compounds, mention may be made of compounds as disclosed in U.S. Pat. No. 4,980,479, which can release a diffusible dye by intramolecular nucleophilic displacement reaction; and compounds as disclosed in U.S. Pat. No. 4,199,354, which can release a diffusible dye by the intramolecular rewinding reaction of isooxazolone ring.

(3) Nondiffusible compounds which can release a diffusible dye by the reaction with the reducing agent remaining unoxidized upon development, as disclosed in U.S. Pat. No. 4,559,290, European Patent 220,746A2, U.S. Pat. No. 4,783,396, Kokai Giho 87-6199, and so on.

Specific examples thereof include compounds which can release a diffusible dye through the intramolecular nucleophilic displacement reaction which takes place after they are reduced, as disclosed, e.g., in U.S. Pat. Nos. 4,139,389 and 4,139,379, JP-A-59-185333, and JP-A-57-84453; compounds which can release a -diffusible dye through the intramolecular electron-transfer reaction which takes place after they are reduced, as disclosed, e.g., in U.S. Pat. No. 4,232,107, JP-A-59-101649, JP-A-61-88257, and RD 24025 (1984); compounds which can release a diffusible dye through single bond fission which takes place after they are reduced, as disclosed, e.g., in German Patent 3,008,588A, JP-A-56-

142530, U.S. Pat. Nos. 4,343,893 and 4,619,884; nitro compounds which can release a diffusible dye after electron acceptance, as disclosed, e.g., in U.S. Pat. No. 4,450,223; and compounds which can release a diffusible dye after electron acceptance, as disclosed, e.g., in U.S. Pat. No. 4,609,610.

As more preferred examples of compounds belonging to the class (3 ), mention may be made of compounds having both N—X bonding (X represents an oxygen, sulfur or nitrogen atom) and an electron attracting group in a molecule, as disclosed in European Patent 220,746A2, Kokai Giho 87-6199, U.S. Pat. No. 4,783,396, JP-A-63-201653, JP-A-63-201654, and so on; compounds having both $SO_2$—X moiety (X is the same as described above) and an electron attracting group in a molecule, as disclosed in JP-A-1-26842; compounds having both PO-X bonding (X is the same as described above) and electron attracting group in a molecule, as disclosed in JP-A-63-27134; and compounds having both C—X' bonding (X ' is the same as X, or —$SO_2$—) and an electron attracting group in a molecule, as disclosed in JP-A-63-271341. In ad-dition, the compounds disclosed in JP-A-1-161237 and JP-A-1-161342, which can release a diffusible dye by single bond fission which takes place after reduction owing to the $\pi$-bond coupled to an electron accepting group, can be utilized.

Among the above-cited compounds, the compounds having both N-X bonding and an electron attracting group in a molecule are preferred in particular. Specific examples of such compounds include those exemplified as the compounds (1)–(3), (7)–(10), (12), (13), (15), (23)–(26), (31), (32), (35), (36), (40), (41), (44), (53)–(59), (64) and (70) in European Patent 220,746A2 or U.S. Pat. No. 4,783,396; and those exemplified as the compounds (11)–(23) in Kokai Giho 87-6199.

(4) Compounds which contain a diffusible dye moiety in their respective split-off groups and can release the diffusible dye through the reaction with the oxidation product of a reducing agent (DDR couplers), with specific examples including those disclosed in British Patent 1,330,524, JP-B-48-39165, U.S. Pat. Nos. 3,443,940, 4,474,867 and 4,483,914, and so on.

(5) Compounds which can reduce silver halide or organic silver salts, and release a diffusible dye when they reduce the object of reduction (DRR compounds), which have an advantage in that they are free from an image-staining trouble attributable to oxidative decomposition products of reducing agents because they require no other reducing agent. Typical representatives of such compounds are disclosed in U.S. Pat. Nos. 3,928,312, 4,053,312, 4,055,428 and 4,336,322, JP-A-59-65839, JP-A-59-69839, JP-A-53-3819, JP-A-51-104343, RD 17465, U.S. Pat. Nos. 3,725,062, 3,728,113 and 3,443,939, JP-A-58-116537, JP-A-57-179840, U.S. Pat. No. 4,500,626, and so on. Specific examples of DRR compounds include those illustrated on columns 22–44 of the above-cited U.S. Pat. No. 4,500,626. In particular, those exemplified therein as the compounds (1)–(3), (10)–(13), (16)–(19), (28)–(30), (33)–(35), (38)–(40), and (42)–(64) are preferred over others. Also, the compounds disclosed in U.S. Pat. No. 4,639,408, columns 37–39, are useful.

In addition to the above-described dye-providing compounds, including couplers and compounds represented by formula [LI], dye-silver compounds in which an organic silver salt is bound to a dye (as described in *Research Disclosure*, pp. 54–58 (May 1978)), azo dyes used for heat-developable silver dye bleach process (as disclosed, e.g., in U.S. Pat. No. 4,235,957, and *Research Disclosure*, pp. 30–32 (April 1976)), and leuco dyes (as disclosed, e.g., in U.S. Pat. Nos. 3,985,565 and 4,022,617) can be used.

Various kinds of antifoggants or photographic stabilizers can be used in this invention. Specific examples of such agents include azoles and azaindenes described in RD 17643, pp. 24–25 (1978), nitrogen-containing carboxylic acids and phosphoric acids disclosed in JP-A-59-168442, mercapto compounds and metal salts thereof disclosed in JP-A-59-111636, acetylene compounds disclosed in JP-A-62-87957, and so on.

As for the binders which can be used for constituent layers of a photosensitive material and a dye-fixing material, hydrophilic ones are desirable. Suitable examples of such binders include those disclosed in JP-A-62-253159, pp. 26–28. More specifically, there can be cited transparent or translucent hydrophilic binders, with examples including natural compounds such as proteins, e.g., gelatin, gelatin derivatives and the like, and polysaccharides, e.g., cellulose derivatives, starch, gum arabic, dextran, pullulan and the like, and synthetic polymeric compounds such as polyvinyl alcohol, polyvinylpyrrolidone, acrylamide polymers and so on. In addition, polymers having high water-absorbing power as disclosed in JP-A-62-245260 and so on, namely homopolymers of vinyl monomers containing —COOM or —$SO_3M$ (wherein M represents a hydrogen or alkali metal atom), copolymers of such vinyl monomers, and copolymers of such vinyl monomers and other vinyl monomers (e.g., copolymer of sodium methacrylate and ammonium methacrylate, such as Sumika Gel L-5H, produced by Sumitomo Chemical Co., Ltd.), can be used. These binders can be used in combination of two or more thereof.

When a system in which heat development is effected by supplying thereto a slight amount of water is adopted, the use of the above-described highly water-absorbing polymers makes it feasible to achieve rapid absorption of water. Moreover, using highly water-absorbing polymers in a dye-fixing layer or other protective layers enables the prevention of retransfer of the transferred dyes from the dye-fixing element to others.

A suitable coverage of binders used in this invention is 20 g/$m^2$or less, preferably 10 g/$m^2$ or less, and particularly preferably 7 g/$m^2$ or less.

Particularly in the case of heat-developable photosensitive materials, a thickness of the photosensitive material has a great influence upon diffusion transfer of dyes since an amount of solvents used at the time of processing is extremely small, compared with those for ordinary wet-processable photosensitive materials. Therefore, it is to be desired that a thickness of the photosensitive material should be controlled to 15 $\mu$m or less, especially 10 $\mu$m or less, on dry basis.

In constituent layers of the photosensitive material or the dye-fixing material (including a backing layer), various polymer latexes can be contained for the purposes of making improvements in physical properties as a film, e.g., for dimensional stabilization, prevention of curling, prevention of adhesion, prevention of cracking, prevention of sensitization or desensitization due to pressure, and so on. Specifically, any of polymer latexes as disclosed in JP-A-62-245258, JP-A-62-136648, JP-A-62-110066, and so on can be used. In particular, using polymer latexes having a low glass transition point (40° C. or lower) in a mordanting layer can prevent the layer from cracking and, on the other hand, using polymer latexes having a high glass transition point in a backing layer can achieve an excellent effect upon prevention of curling.

When the photosensitive material of this invention is processed by way of heat development, organic metal salts can be used as an oxidizing agent together with light-sensitive silver halides. Among organic metal salts, organic silver salts are favored in particular.

Examples of organic compounds which can be used for forming an organic silver salt oxidizing agent include benzotriazoles, fatty acids and other compounds as described in U.S. Pat. No. 4,500,626, on columns 52–53. Also, silver salts of alkynyl group-containing carboxylic acids, such as silver phenylpropiolate, disclosed in JP-A-60-113235, and acetylene silver disclosed in JP-A-61-249044 are useful. Such organic silver salts may be used in combination with two or more thereof.

The above-described organic silver salts can be used in an amount of from 0.01 to 10 moles, preferably from 0.01 to 1 mole, per mole of light-sensitive silver halide. An appropriate coverage of light-sensitive silver halides and that of organic silver salts amount to from 50 $mg/m^2$ to 10 $g/m^2$ in all.

A reducing agent in this invention may be incorporated in the photosensitive material, or supplied at the time of processing to the photosensitive material (and to the dye fixing material) as one component of a processing composition retained in a rupturable container. The former form is suitable for the-processing by way of heat development, and the latter form is adopted preferably in the processing carried out in the vicinity of ordinary temperature, that is to say, in the color diffusion transfer process.

As for the reducing agent, those known in this field can be used. Therein, dye-providing compound having reducing power, as described hereinafter, are included, too. (In this case, such compounds can also be used together with other reducing agents.) In addition, precursors of reducing agents, which themselves have no reducing power, but can exhibit reducing power through interaction with a nucleophilic reagent or heat in the course of development, can be used.

Specific examples of reducing agents which can be used in this invention include the reducing agents and the precursors thereof disclosed in U.S. Pat. No. 4,500,626 (columns 49–50), U.S. Pat. No. 4,483,914 (columns 30–31), U.S. Pat. No. 4,330,617, U.S. Pat. No. 4,590,152, JP-A-60-140335 (pages 17–18), JP-A-57-40245, JP-A-56-138736, JP-A-59-178458, JP-A-59-53831, JP-A-59-182449, JP-A-59-182450, JP-A-60-119555, from JP-A-60-128436 to JP-A-60-128439, JP-A-60-198540, JP-A-60-181742, JP-A-61-259253, JP-A-62-244044, from JP-A-62-131253 to JP-A-62-131256, European Patent 220,746A2 (pages 78–96), and so on.

Also, combinations of various reducing agents as disclosed in U.S. Pat. No. 3,039,869 can be used.

When reducing agents used are nondiffusible, they can be used in combination with electron transfer agents and/or precursors thereof, if needed, in order to promote the electron transfer between the nondiffusible reducing agent and the developable silver halide.

Such electron transfer agents or precursors thereof can be chosen from the above-cited reducing agents and their precursors. It is to be desired that the electron transfer agents should have greater mobility than nondiffusible reducing agents (electron donors). Especially useful electron transfers are 1-phenyl-3-pyrazolidones and aminophenols. As for the nondiffusible reducing agent (electron donor) used in combinanation with an electron transfer agent, any of the above-cited ones can be employed as far as they are substantially immobile in constituent layers of the photosensitive element. Those preferred as such reducing agents are hydroquinones, sulfonamidophenols, sulfonamido-naphthols, the compounds disclosed as electron donors in JP-A-53-110827, and such dye-providing compounds as described below which are nondiffusible and have reducing power.

A suitable amount of a reducing agent added ranges from 0.001 to 20 moles, particularly from 0.01 to 10 moles, per mole of silver.

Hydrophobic additives such as dye-providing compounds, nondiffusible reducing agents and so on can be introduced into constituent layers of the photosensitive material using known methods, e.g., the method disclosed in U.S. Pat. No. 2,322,027. Therein, high boiling organic solvents as disclosed in JP-A-59-83154, JP-A-59-178451, JP-A-59-178452, JP-A-59-178453, JP-A-59-178454, JP-A-59-178455, JP-A-59-178455 and so on can be used, if desired, together with low boiling organic solvents having a boiling point of from 50° C. to 160° C.

High boiling organic solvents are used in an amount of 10 g or less, preferably 5 g or less, per gram of the dye-providing compounds used. On the other hand, they are used in an amount of 1 ml or less, preferably 0.5 ml or less, and particularly preferably 0.3 ml or less, per gram of binders used.

The dispersion methods utilizing polymers, which are disclosed in JP-B-51-39853 and JP-A-51-59943, can also be employed.

When compounds used as additives are, in substantial sense, insoluble in water, they can be dispersed into a binder in the form of fine particles, besides using the above-described methods.

In dispersing hydrophobic compounds into a hydrophilic colloid, various kinds of surface active agents can be used. For instance, those cited as surface active agents in JP-A-59-157636, pages 37–38, can be used.

In processing by heat development, compounds capable of activating development and stabilizing image at the same time can be introduced into the photosensitive material. Concrete examples of such compounds are disclosed in U.S. Pat. No. 4,500,626 , columns 51–52.

In the system of this invention, wherein images are formed by diffusion transfer of dyes, a dye-fixing material (image-receiving material) is used in combination with the photosensitive material. The dye-fixing material and the photosensitive material may assume such a form that their respective supports are different ones, or such a form that their supports are the same. As for the relationship between the photosensitive material and the dye-fixing material, the relationship to support and the relationship to a white reflecting layer, those described in U.S. Pat. No. 4,500,626, column 57, can be applied to this invention, too.

A dye-fixing material which can be preferably used in this invention has at least one layer containing a mordant and a binder. As for the mordant, those known in the field of photography can be used. Specific examples thereof include those disclosed in U.S. Pat. No. 4,500,629 (columns 58–59), JP-A-61-88256 (pages 32–41), JP-A-62-244043, JP-A-62-244036, and so on. Also, transition metal ions for chelating the diffused dyes may be contained.

It is desirable in particular in this invention to use polymeric mordants comprising tertiary nitrogen-containing monomers (especially those free from quaternary ammonium group) in the dye-fixing material.

Specific examples of preferable homo- and copolymers comprising tertiary nitrogen-containing vinyl monomer units are illustrated below. Herein, figures attached to monomer units represent mole %.

(1)

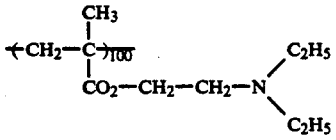

(2)

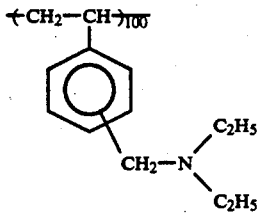

(3)

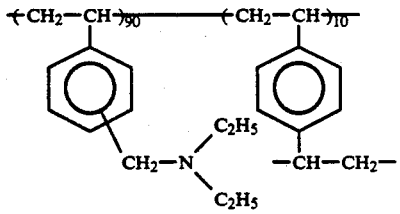

(4)

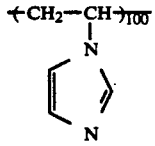

(5)

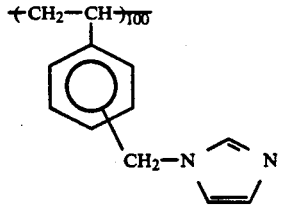

(6)

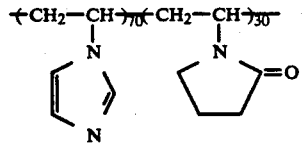

(7)

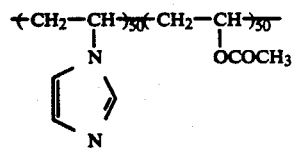

(8)

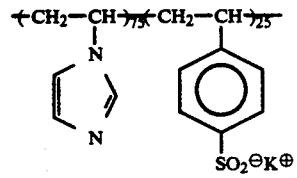

-continued (9)

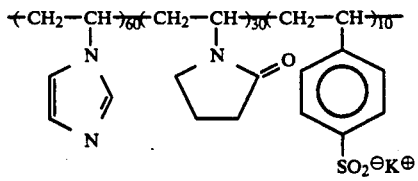

(10)

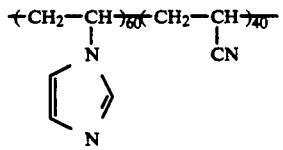

(11)

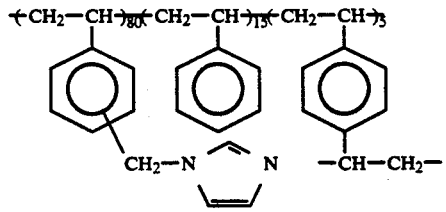

Among the above-illustrated polymers, homo- or copolymers comprising vinyl monomer units containing a tertiary imidazolyl group, such as the polymers from (4) to (11), are favored in particular over others. These polymers are described in detail, e.g., in U.S. Pat. Nos. 4,282,305, 4,115,124 and 3,148,061, JP-A-60-118834, and JP-A-60-122941.

As another means for fixing dyes, dye-accepting high molecular compounds as disclosed in U.S. Pat. No. 4,463,079 may be adopted.

The dye-fixing material can be provided with a protective layer, a peel-apart layer, a neutralizing layer, a timing layer, an anticurling layer and other auxiliary layers, if desired. In particular, it is advantageous to the dye-fixing layer to have a protective layer.

In cases where processing is effected by heat development, the photosensitive material and the dye-fixing material need not be provided with a neutralizing layer and a timing layer, because the pH required for the processing is not no high.

In the constituent layers of the photosensitive material and the dye-fixing material, a plasticizer, a slipping agent, or a high boiling organic solvent to facilitate the peeling of the dye-fixing material from the photosensitive material can be used. Specific examples of such agents include those disclosed in JP-A-62-253159 (on page 25), JP-A-62-245253, and so on.

For the above-described purpose, every kind of silicone oil (including dimethylsilicone oil and modified silicone oils obtained by introducing various kinds of organic groups into dimethylsiloxane) can be used, too. For instance, various modified silicone oils described in *Gijutsu Siryo* P6-18B, entitled "Modified Silicone Oils", published by Shin-Etsu Silicone, Co., Ltd., especially carboxyl-modified silicone (X-22-3710, a trade name), can be employed effectively.

Also, silicone oils disclosed in JP-A-62-215953 and JP-A-63-46449 are effective for that purpose.

In the photosensitive material and the dye-fixing material, discoloration inhibitors may be used. Suitable examples thereof include antioxidants, ultraviolet absorbents, and various kinds of metal complexes.

Specific examples of antioxidants include chroman compounds, coumaran compounds, phenol compounds (e.g., hindered phenols), hydroquinone derivatives, hindered amine derivatives, and spiro-indane compounds. Also, the compounds disclosed in JP-A-61-159644 are effective.

Specific examples of ultraviolet absorbents include benzotriazole compounds (such as those disclosed in U.S. Pat. No. 3,533,794), 4-thiazolidone compounds (such as those disclosed in U.S. Pat. No. 3,352,681), benzophenone compounds (such as those disclosed in JP-A-46-2784), and those disclosed in JP-A-54-48535, JP-A-62-136641, JP-A-61-88256 and so on. In addition, the ultraviolet absorbing polymers disclosed in JP-A-62-260152 are also effective.

Specific examples of metal complexes include the compounds disclosed in U.S. Pat. Nos. 4,241,155, 4,245,018 (columns 3–36), 4,254,195 (columns 3–8), JP-A-62-174741, JP-A-61-88256 (pages 27–29), JP-A-63-199248, JP-A-1-75568, JP-A-1-74272, and so on.

Moreover, examples of useful discoloration inhibitors are disclosed in JP-A-62-215272 (pages 125–137).

For preventing dyes transferred into the dye-fixing material from discoloring, the discoloration inhibitors may be incorporated in advance in the dye-fixing material, or supplied externally to the dye-fixing material, e.g., from the photosensitive material.

The above-described antioxidants, ultraviolet absorbents and metal complexes may be used in combination with two or more thereof.

In the photosensitive material and the dye-fixing material, a brightening agent may be contained. In particular, it is desirable that the brightening agent should be incorporated in the dye-fixing material, or should be supplied externally, e.g., from the photosensitive material. Suitable examples of such a brightening agent include compounds described, e.g., in K. Veenkataraman, *The Chemistry of Synthetic Dyes*, vol. V, chap. 8, JP-A-61-143752, and so on. More specifically, stilbene compounds, coumarin compounds, biphenyl compound, benzoxazolyl compounds, naphthalimide compounds, pyrazoline compounds and carbostyryl compounds can be given as examples.

Such a brightening agent can be used in combination with discoloration inhibitors.

As for the hardener which can be used in constituent layers of the photosensitive material and the dye-fixing material, those disclosed in U.S. Pat. No. 4,678,739 (column 41), JP-A-59-116655, JP-A-62-245261, JP-A-61-18942, and so on can be cited as instances. More specifically, aldehyde hardeners (e.g., formaldehyde), aziridine hardeners, epoxy hardeners (e.g.

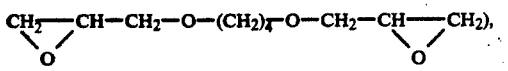

vinylsulfone hardeners (e.g., N,N'-ethylenebis(vinylsulfonylacetamido)ethane), N-methylol hardeners (e.g., dimethylolurea), or polymeric hardeners (as disclosed in JP-A-62-234157)can be instanced.

In constituent layers of the photosensitive material and the dye-fixing material, various kinds of surface active agents can be used for many purposes, e.g., as coating aids, for improvements on peeling facility and slippability, for prevention of electrification, for acceleration of development, and so on. Specific examples of surface active agents are disclosed, e.g., in JP-A-62-173463, JP-A-62-183457.

Also, organic fluorine compounds may be contained in the photosensitive material or the dye-providing material for the purpose of improvements upon slippability, antistatic property and peeling facility. As typical examples of organic fluorine compounds, mention may be made of fluorine-containing surfactants as disclosed in JP-B-57-9053 (columns 8–17), JP-A-61-20944, JP-A-62-135826 and so on, and hydrophobic fluorine compounds including oily fluorine compounds such as fluorocarbon oil, and solid fluororesins such as tetrafluoroethylene resin, etc.

In the photosensitive material and the dye-fixing material, a matting agent can be used. Specific examples of usable matting agents include silicon dioxide, the compounds disclosed in JP-A-61-88256 (page 29), such as polyolefins, polymethacrylates, etc., and the compounds disclosed in JP-A-63-274944 and JP-A-63-274952, such as benzoguanamine resin beads, polycarbonate resin beads, AS resin beads, etc.

In addition to the above-described additives, thermal solvents, defoaming agents, antibacterial and antifungal agents, colloidal silica and so on may be contained in constituent layers of the photosensitive material and dye-fixing material. Concrete examples of such additives are described in JP-A-61-88256, pages 26–32.

In the photosensitive material and/or the dye-fixing material, an accelerator for image formation can be used. The use of an image-formation accelerator is desirable in particular when the processing is effected by heat development. The image-formation accelerator is intended to include compounds which can function so as to accelerate the redox reaction between a silver salt oxidant and a reducing agent, so as to accelerate the formation of dyes, the decomposition of dyes or the release of diffusible dyes from dye-providing substances, so as to accelerate the transfer of dyes from light-sensitive layers into dye-fixing layers, or so on. From the viewpoint of physical chemistry, the image-formation accelerators can be classified into several groups, namely the group bases and precursors thereof, that of nucleophilic compounds, that of high boiling organic solvents (oils), that of thermal solvents, that of surfactants that of compounds capable of interacting with silver or silver ion, and so on. However, substances classified into these groups generally have a multi-function, or have some of the above-described accelerating effects in combination. Details of these accelerators are described in U.S. Pat. No. 4,678,739, columns 38–40.

As for the precursors of bases, there can be adopted the salts formed by bases and organic acids capable of undergoing decarboxylation upon heating, and compounds capable of releasing amines through intramolecular nucleophilic replacement reaction, Lossen rearrangement or Beckmann rearrangement. Specific examples of such precursors are disclosed in U.S. Pat. No. 4,511,493, and JP-A-62-65038.

In a system of performing heat development and dye transfer at the same time in the presence of a small amount of water, it is desirable for heightening the storage stability of the photosensitive material that a base and/or a precursor thereof should be incorporated in the dye-fixing material.

In addition to the above-cited compounds, the combinations of slightly soluble metal compounds with compounds capable of undergoing complexation reaction with metal ions constituting these slightly soluble metal compounds (called complexing compounds) disclosed in European Patent 210,660A and U.S. Pat. No. 4,740,445, and compounds capable of producing bases by electrolysis disclosed in JP-A-61-232451 can be used as precursors of bases. Such a slightly soluble metal compound and a complexing compound are used to advantage when they are added separately to the photosensitive material and the dye-fixing material.

In the photosensitive material and/or the dye-fixing material of this invention, various development stoppers can be used for the purpose of always providing images of constant quality without influenced by fluctuation of a processing temperature and a processing time in development.

The term "development stoppers" as used herein is intended to include compounds capable of stopping the development by quickly neutralizing or reacting with a base after proper development to lower a base concentration in the film, and compounds capable of restraining development through interaction with silver and silver salts. As concrete examples of such compounds, mention may be made of acid precursors capable of releasing acids by heating, electrophilic compounds capable of undergoing a displacement reaction with the base present together by heating, nitrogen-containing heterocyclic compounds, and mercapto compounds and precursors thereof. Details of these compounds are described in JP-A-62-253159, pages 31–32.

As for the support for the photosensitive material and the dye-fixing material of this invention, paper and synthetic polymer films are generally used. More specifically, films of polyethylene terephthalate, polycarbonates, polyvinyl chloride, polystyrene, polypropylene, polyimides, celluloses (e.g., triacetyl cellulose), these films in which a pigment such as titanium oxide is dispersed, film process synthetic papers made, e.g., from polypropylene, paper made from a mixture of synthetic resin pulp (e.g., polyethylene pulp) and natural pulp, Yankee paper, baryta paper, coated paper (especially cast-coat paper), metals, cloths, glass and so on can be employed.

These materials can be used alone, or supports laminated with a synthetic polymer film such as polyethylene film on either side or both sides thereof.

In addition to the above-cited materials, the supports disclosed in JP-A-62-253159, pages 29–31, can be used, too.

On the surface of a support as described above, a hydrophilic binder, alumina sol, a semiconductive metallic oxide such as tin oxide, and an antistatic agent such as carbon black may be coated.

As for the method of exposing imagewise the photosensitive material and recording the image therein, a method of directly taking a photograph of landscape, figure or so on by a camera, a method of exposing the photosensitive material to light through a reversal film or a negative film by means of a printer, an enlarger or the like, a method of exposing the photosensitive material to light through a slit by scanning an original with an exposure device of a copying machine, a method of exposing the photosensitive material to light emitted from a light-emitting diode or various kinds of laser devices by transmitting thereto image information in the form of electric signals, a method of exposing the photosensitive material to image information taken out as output on an image display unit, such as CRT, a liquid crystal display, an electroluminessence display, plasma display or the like, directly or through an optical system, and so on can be adopted.

As the light source for recording images in the photosensitive material, as described above, natural light, a tungsten lamp, a light emitting diode, a laser device, CRT and other devices described in U.S. Pat. No. 4,500,626 (on column 56) can be used.

Also, imagewise exposure can be effected by means of a wavelength converting element utilizing the combination of a non-linear optical material and a coherent light source such as laser beams. The term "non-linear optical material" as used herein refers to the material which can bring about non-linear relationship between the amount of polarization appearing upon application of strong photoelectric field, such as laser beams, and the electric field applied, with suitable examples including inorganic compounds represented by lithium niobate, potassium dihydrogenphosphate (PDK), lithium iodate and $BaB_2O_4$, and organic compounds represented by urea derivatives, nitroaniline derivatives, nitropyridine-N-oxide derivatives such as 3-methyl-4-nitropyridine-N-oxide (POM), and the compounds disclosed in JP-A-61-53462 and JP-A-62-210432. As a form of the wavelength converting element, the form of a single crystal light wave guide, the form of fiber and so on are known, and all of them are useful.

As for the above-described image information, image signals obtained from video cameras, electronic still cameras or the like, TV signals represented by Nippon Television Signal Code (NTSC), image signals obtained dividing the original image into a large number of picture elements by means of a scanner, and image signals formed by means of an electronic computer, represented by CG and CAD, can be utilized.

The photosensitive material and/or the dye-fixing material may assume such a form as to have a conductive heat-evolving layer as a heating means for heat development or diffusion transfer of dyes by heating. Therein, transparent or opaque heat-evolving elements as disclosed, e.g., in JP-A-61-145544 can be used. Such a conductive layer can function as an antistatic layer, too.

The diffusion transfer photographic material of this invention may be processed in accordance with the so-called color diffusion transfer process in which image formation is effected using an alkaline processing composition at ordinary temperature, or may be processed by heat development. As for the color diffusion transfer process, known various embodiments can be adopted.

The processing by heat development is described below in detail.

As for the heating temperature in the step of heat development, a developable temperature is within the range of about 50° C. to 250° C., and the development can proceed efficiently at temperatures from about 80° C. to 180° C. The step of diffusion transfer of dyes may be carried out simultaneously with heat development, or subsequently to the conclusion of heat development. In the latter case, a heating temperature in the transfer step, though may range from the temperature of the heat development to room temperature, are preferably within the range of 50° C. to the temperature lower than that in the heat development step by about 10° C.

Although transfer of dyes can be caused by heat alone, a solvent may be used for promoting the transfer of dyes.

In addition, as described in detail in JP-A-59-218443 and JP-A-61-238056, a method of carrying out the development and the transfer in the presence of a small amount of solvent (especially water) simultaneously or successively is useful, too. In this form, a heating temperature is preferably 50° C. or higher, and that not higher than the boiling point of the solvent used. In the case of using water as solvent, for instance, a temperature range of 50° C. to 100° C. is desirable.

As examples of a solvent which can be used for accelerating development and/or transferring diffusible dyes into a dye-fixing layer, mention may be made of water, alkaline aqueous solutions containing inorganic alkali metal salts or organic bases (specific examples thereof include those cited as bases in the paragraph of image formation accelerator). Also, low boiling solvents, or solvent mixtures of low boiling solvents with water or alkaline aqueous solutions can be used. Further, surfactants, antifoggants, slightly insoluble metal salts, complexing compounds and so on may be contained in such solvents.

These solvents can be introduced into either or both of the dye-fixing material and the photosensitive material. They can be effectively used in a small amount, or less than the weight of the solvent corresponding to the maximum swelling volume of the whole coated layers (especially, less than the amount remaining after deducting the weight of the whole coated layers from the weight of solvent corresponding to the maximum swelling volume of the whole coated layers).

As a method of giving solvents to the photosensitive layer or the dye-fixing layer, there is one which is disclosed in JP-A-61-147244 (on page 26). Also, solvents can be incorporated in advance in the photosensitive material or/and the dye-fixing material in the form of microcapsules.

Further, a method of incorporating a hydrophilic thermal solvent, which is solid at ordinary temperature but fuses at high temperatures, into the photosensitive material or the dye-fixing material can be adopted for the purpose of acceleration of dye transfer. Such hydrophilic thermal solvents may be incorporated in either or both of the sensitive material and the dye-fixing material. A layer in which such solvents are incorporated may be an emulsion layer, an interlayer, a protective layer, or a dye-fixing layer. In particular, it is preferred to incorporate them into a dye-fixing layer and/or an adjacent layer thereof.

Specific examples of a hydrophilic thermal solvent which can be used include ureas, pyridines, amides, sulfonamides, imides, alcohols, oximes, and other heterocyclic compounds.

Furthermore, high boiling organic solvents may be incorporated in advance in the photosensitive material or/and the dye-fixing material for the purpose of acceleration of dye transfer.

Heating in the development step and/or in the transfer step can be performed, e.g., through direct contact with a heated block or plate, by bringing the material(s) into contact with a hot plate, a hot presser, a hot roller, a halogen lamp heater, an infrared or far infrared lamp heater, or by making the material(s) pass through a high temperature atmosphere.

In bringing the dye-fixing material superposed upon the photosensitive material into close contact with each other, the pressure-applying conditions and means disclosed in JP-A-61-147244 (on page 27) can be adopted.

Any of various heat development apparatus may be used in the processing of the photographic elements of this invention. For instance, those disclosed in JP-A-59-75247, JP-A-59-177547, JP-A-59-181353, JP-A-60-18951, and JP-A-U-62-25944 (the term "JP-A-U" as used herein means an "unexamined published Japanese utility model application") are used to advantage.

EXAMPLE 1

A heat developable color photosensitive material having a multilayer structure was prepared as follows:

In the first place, preparation of Emulsion (I) for the fifth layer is described below.

To a vigorously stirred aqueous gelatin solution (prepared by adding 20 g of gelatin, 3 g of potassium bromide, 0.03 g of Compound (1) illustrated below and 0.25 g of $HO(CH_2)_2S(CH_2)_2S(CH_2)_2OH$ to 800 ml of water, and by keeping the mixture at 50° C.), the following solutions (1) and (2) were added simultaneously over a 30-minute period. Thereafter, the following solutions (3) and (4) were further added simultaneously over a 20-minute period. Furthermore, the addition of the following dye solution was started after a 5-minute lapse from the beginning of the addition of the solutions (3) and (4), and completed in 18 minutes.

After washing and subsequent desalting steps, the obtained emulsion was admixed with 20 g of lime-processed ossein gelatin, adjusted to pH 6.2 and pAg 8.5, and then chemically sensitized to the optimum extent by the addition of sodium thiosulfate, 4-hydroxy-6-methyl-1,3,3a,7-tetrazaindene and chloroauric acid. Thus, 600 g of a monodisperse cubic silver chlorobromide emulsion having an average grain size of 0.40 μm was obtained.

| | Solution (1) (water to make 180 ml) | Solution (2) (water to make 180 ml) | Solution (3) (water to make 350 ml) | Solution (4) (water to make 350 ml) |
|---|---|---|---|---|
| $AgNO_3$ | 30 g | — | 70 g | — |
| KBr | — | 17.8 g | — | 49 g |
| NaCl | — | 1.6 g | — | — |

Dye Solution

A solution containing 0.18 g of

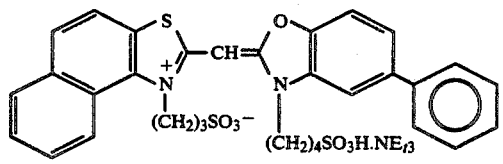

and 0.06 g of

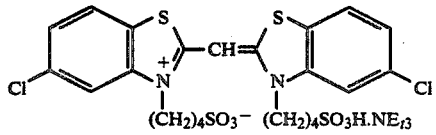

in 160 ml of methanol.

Compound (1)

-continued

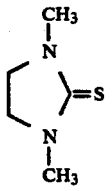

In the next place, preparation of Emulsion (II) for the third layer is described below.

To a vigorously stirred aqueous solution (prepared by adding 20 ml g of gelatin, 0.30 g of potassium bromide, 6 g of sodium chloride and 0.015 g of the reagent A illustrated below to 730 ml of water, and keeping the mixture at 60.0° C.), the following solutions (I) and (II) were added simultaneously over a 60-minute period at an equal flow rate. At the conclusion of the addition of the solutions (I) and (II), a methanol solution (III) containing the following sensitizing dye C was added. Thus, a monodisperse dye-adsorbed cubic emulsion grains having an average size of 0.45 μm was prepared. After washing and subsequent desalting steps, the emulsion was mixed with 20 g of gelatin, adjusted to pH 6.4 and pAg 7.8, and then chemically sensitized. Reagents used therein were 1.6 mg of sodium thiosulfate and 100 mg of 4-hydroxy-6-methyl-1,3,3a,7-tetrazaindene, and the ripening time was 55 minutes. The yield of the thus obtained emulsion was 635 g.

Reagent A

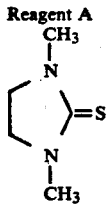

Sensitizing Dye C

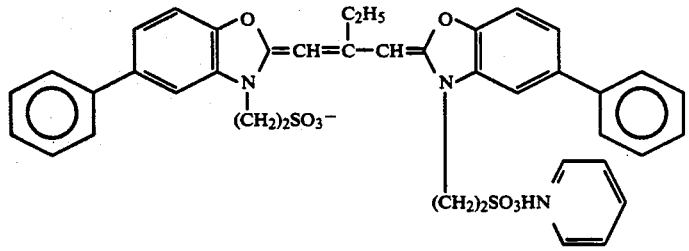

| | Solution (I) (water added to make 400 ml) | Solution (II) (water added to make 400 ml | Solution (III) (methanol added to make 77 ml) |
|---|---|---|---|
| $AgNO_3$ | 100.0 g | — | — |
| KBr | — | 56.0 g | — |
| NaCl | — | 7.2 g | — |
| Dye C | — | — | 0.23 g |

Then, preparation of Emulsion (III) for the first layer is described below.

To a vigorously stirred aqueous gelatin solution (prepared by adding 20 g of gelatin, 0.3 g of potassium bromide, 6 g of sodium chloride and 30 mg of the following reagent A to 800 ml of water, and keeping the mixture at 50° C.), the following solutions (I) and (II) were added simultaneously over a 30-minute period at an equal flow rate. Thereafter, the following solutions (III) and (IV) were further added simultaneously over a 30-minute period. Furthermore, the addition of the following dye solution was started after a 3-minute lapse from the beginning of the addition of the solutions (III) and (IV), and completed in 20 minutes.

After washing and subsequent desalting steps, the obtained emulsion was mixed with 20 g of lime-processed ossein gelatin, adjusted to pH 6.2 and pAg 7.7, and then chemically sensitized to the optimum extent by the addition of sodium thiosulfate, 4-hydroxy-6-methyl-1,3,3a,7-tetrazaindene and chloroauric acid. Thus, 635 g of a monodisperse cubic silver chlororomode emulsion having an average grain size of 0.38 μm was obtained.

| | Solution (I) (water added to make 200 ml) | Solution (II) (water added to make 200 ml) |
|---|---|---|
| $AgNO_3$ | 50.0 g | — |
| KBr | — | 28.0 g |
| NaCl | — | 3.4 g |
| | Solution (III) (water added to make 200 ml) | Solution (IV) (water added to make 200 ml) |
| $AgNO_3$ | 50.0 g | — |
| KBr | — | 35.0 g |

Reagent A

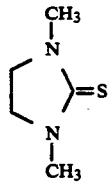

Dye Solution

A solution obtained by dissolving 67 mg of the following dye (a) and 133 mg of the following dye (b) in 100 ml of methanol.

[Dye (a)]

-continued

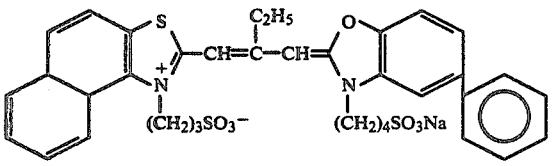

[Dye (b)]

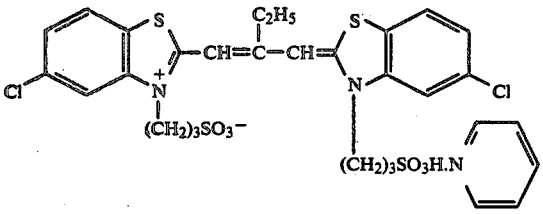

In addition, a dispersion of zinc hydroxide was prepared in the following manner:

12.55 g of zinc hydroxide having an average grain size of 0.2 μ, 1 g of carboxymethyl cellulose as a dispersant, and 0.1 g of sodium polyacrylate were added to 100 ml of a 4% aqueous solution of gelatin, and ground for 20 minutes using glass beads having an average size of 0.75 mm in a mill. The glass beads were separated therefrom, resulting in the preparation of a zinc hydroxide dispersion.

Moreover, a dispersion of an electron transfer agent was prepared in the following manner:

10 g of the electron transfer agent illustrated below, 0.5 g of polyethylene glycol nonylphenyl ether as a dispersant and 0.5 g of the following anionic surfactant were added, and ground for 60 minutes using glass beads having an average size of 0.75 mm in a mill. Then, the glass beads were separated therefrom, and a dispersion of the electron transfer agent having an average grain size of 0.3 μm was obtained.

Electron Transfer Agent

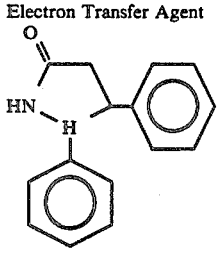

Anionic Surfactant

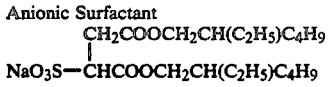

Next, gelatin dispersions of dye-providing compounds were prepared in the following manners:

Yellow, magenta and cyan compositions described below were added to separate 50 ml portions of ethyl acetate, respectively, and heated to about 60° C. to prepare homogeneous solutions. These solutions each was mixed with 100 g of a 10% aqueous solution of lime-processed gelatin, 0.6 g of sodium dodexylbenzenesulfonate and 50 ml of water, and stirred. Thereafter, the mixture was further mechanically dispersed for 10 minutes with a homogenizer rotating at 10,000 rpm. Thus, the intended gelatin dispersion of the dye-providing compounds were obtained.

| | Yellow | Magenta | Cyan |
|---|---|---|---|
| Dye-providing Compound | (1) 13 g | (2) 15.5 g | (3) 16.6 g |
| Electron Donor (1) | 10.2 g | 8.6 g | 8.1 g |
| High Boiling Solvent (2) | 6.5 g | 7.8 g | 8.3 g |
| Electron Transfer Agent Precursor (3) | — | 2.1 g | 2.1 g |

Dye-providing Compound (1)

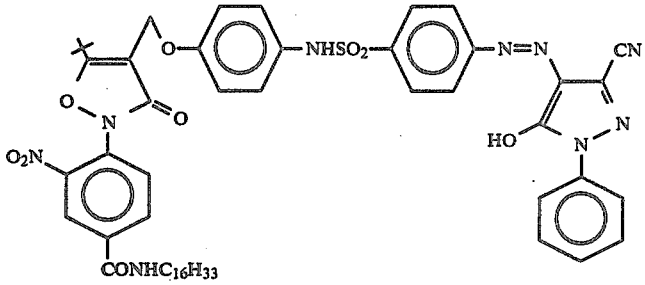

Dye-providing Compound (2)

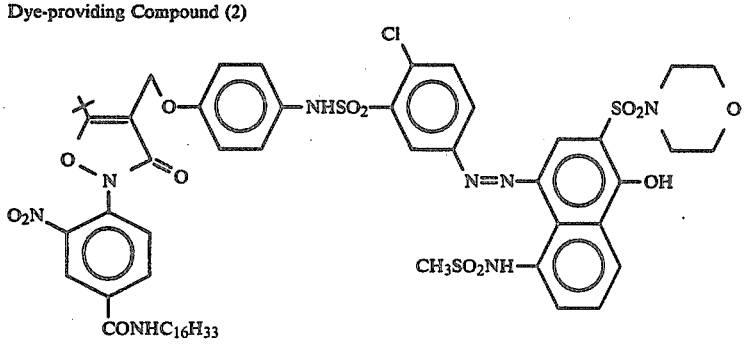

Dye-providing Compound (3)

-continued

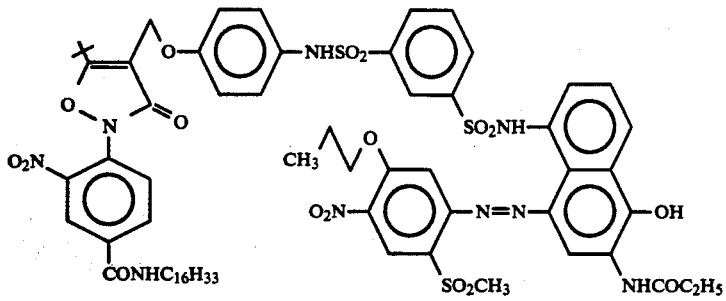

Electron Donor (1)

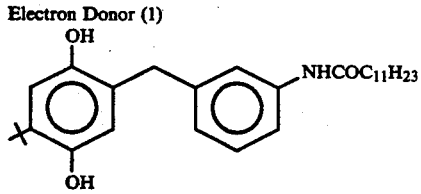

High Boiling Solvent (2)

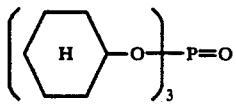

Electron Transfer Agent Precursor (3)

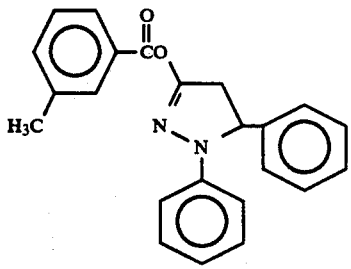

Then, a gelatin dispersion of the electron donor (4) for an interlayer was prepared as follows.

23.6 g of the electron donor (4) illustrated below and 8.5 g of the above-illustrated high boiling solvent (2) were added to 30 ml of ethyl acetate, and made into a homogeneous solution. This solution was mixed with 100 g of a 10% aqueous solution of lime-processed gelatin, 0.25 g of sodium hydrogen sulfite, 0.3 g of sodium dodexylbenzenesulfonate and 30 ml of water with stirring. The resulting mixture was mechanically dispersed for 10 minutes with a homogenizer rotating at 10,000 rpm. Thus, the intended gelatin dispersion of the electron donor (4) was obtained.

Electron Donor (4)

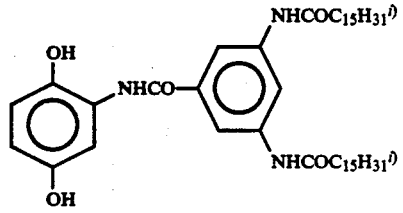

Using the above-described materials, a heat developable color photosensitive material having a multilayer structure shown in the following Table 1 was prepared. It was named Photosensitive Material 101.

TABLE 1

| Constitution of Photosensitive Material 101 | | | |
|---|---|---|---|
| Ordinal Number of Layer | Name of Layer | Ingredient | Coverage (mg/m²) |
| 6th | Protective layer | Gelatin | 900 |
| | | Silica (size: 4μ) | 40 |
| | | Zinc hydroxide | 600 |
| | | Surfactant (5) *1) | 130 |
| | | Surfactant (6) *2) | 26 |
| | | Water-soluble polymer (12) *3) | 8 |
| 5th | Blue-sensitive emulsion layer | Light-sensitive silver halide emulsion (I) | 380** |
| | | Yellow dye-providing compound (1) | 400 |
| | | Gelatin | 600 |
| | | Electron donor (1) | 308 |
| | | High boiling solvent (2) | 200 |
| | | Antifoggant (25) *4) | 0.6 |
| | | Surfactant (7) *5) | 18 |
| | | Water-soluble polymer (12) *3) | 13 |
| 4th | Interlayer | Gelatin | 700 |
| | | Polyvinyl alcohol *6) | 200 |
| | | Electron donor (4) | 130 |
| | | High boiling solvent (2) | 48 |
| | | Surfactant (6) *2) | 15 |

TABLE 1-continued

Constitution of Photosensitive Material 101

| Ordinal Number of Layer | Name of Layer | Ingredient | Coverage (mg/m²) |
|---|---|---|---|
| | | Surfactant (8) *7) | 30 |
| | | Surfactant (7) *5) | 2 |
| | | Electron transfer agent (9) *8) | 81 |
| | | Water-soluble polymer (12) *3) | 19 |
| | | Hardener (10) *9) | 37 |
| 3rd | Green-sensitive emulsion layer | Light-sensitive silver halide emulsion (II) | 220** |
| | | Magenta dye-providing compound (2) | 365 |
| | | Gelatin | 310 |
| | | Electron donor (1) | 158 |
| | | High boiling solvent (2) | 183 |
| | | Electron transfer agent precursor (3) | 38 |
| | | Surfactant (7) *5) | 13 |
| | | Water-soluble polymer (12) *3) | 11 |
| | | Antifoggant (25) *4) | 0.8 |
| 2nd | Interlayer | Gelatin | 790 |
| | | Zinc hydroxide | 300 |
| | | Electron donor (4) | 130 |
| | | High boiling solvent (2) | 73 |
| | | Surfactant (7) *5) | 2 |
| | | Surfactant (5) *1) | 100 |
| | | Surfactant (6) *2) | 11 |
| | | Water-soluble polymer (12) *3) | 12 |
| 1st | Red-sensitive emulsion layer | Light-sensitive silver halide emulsion (III) | 230** |
| | | Cyan dye-providing compound (2) | 343 |
| | | Gelatin | 330 |
| | | Electron donor (1) | 163 |
| | | High boiling solvent (2) | 172 |
| | | Electron transfer agent precursor (3) | 43 |
| | | Surfactant (7) *5) | 10 |
| | | Water-soluble polymer (12) *3) | 5 |
| | | Antifoggant (11) *10) | 0.7 |
| Support | 96 μm-thick polyethylene terephthalate film (provided with a baking layer of carbon black) | | |

**coverage based on silver.

*1) Surfactant (5)

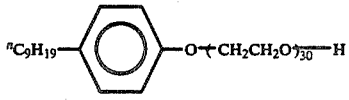

*2) Surfactant (6)

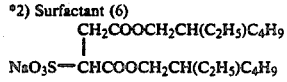

*3) Water-soluble polymer (12)

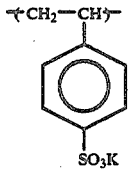

*4) Antifoggant (25)

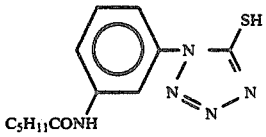

*5) Surfactant (7)

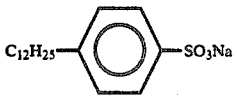

*6) Polyvinyl alcohol (molecular weight: 2,000)

*7) Surfactant (8)

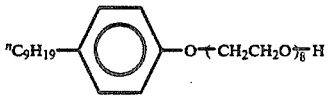

*8) Electron transfer agent (9)

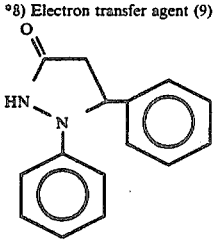

*9) Hardener (10) 1,2-Bis(vinylsulfonylacetamido)ethane

*10) Antifoggant (11)

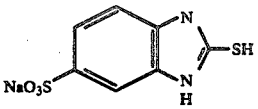

Separately, a dye-fixing material having the constitution described in the following table was prepared, and named Image-Receiving Material R-1.

TABLE 2

Constitution of Image-Receiving Material R-1

| | Additives | Coverage (g/m²) |
|---|---|---|
| 3rd Layer | Gelatin | 0.05 |
| | Silicone oil (13) *1) | 0.04 |
| | Surfactant (14) *2) | 0.001 |
| | Surfactant (15) *3) | 0.02 |
| | Surfactant (16) *4) | 0.10 |
| | Silica (size: 4μ) | 0.02 |
| | Guanidine picolinate | 0.55 |

TABLE 2-continued

| | | |
|---|---|---|
| | Water-soluble polymer (17) *7) | 0.24 |
| 2nd Layer | Mordant (18) *9) | 2.35 |
| | Water-soluble polymer (17) | 0.20 |
| | Gelatin | 1.40 |
| | Water-soluble polymer (19) *8) | 0.60 |
| | High boiling solvent (20) *10) | 1.40 |
| | Guanidine picolinate | 2.40 |
| | Brightening agent (21) *5) | 0.05 |
| | Surfactant (22) *6) | 0.15 |
| 1st Layer | Gelatin | 0.45 |
| | Surfactant (16) | 0.01 |
| | Water-soluble polymer (17) | 0.04 |
| | Hardener (13) *11) | 0.30 |

Support

| | | |
|---|---|---|
| 1st Backing | Gelatin | 3.25 |
| Layer | Hardener | 0.25 |
| 2nd Backing | Gelatin | 0.44 |
| Layer | Silicone oil (13) | 0.08 |
| | Surfactant (5) | 0.04 |
| | Surfactant (22) | 0.01 |
| | Matting agent (24) *12) | 0.03 |

Constitution of Support:

| Name of Layer | Ingredients | Thickness (μ) |
|---|---|---|
| Surface Subbing Layer | Gelatin | 0.1 |
| Surface PE Layer (glossy) | Low density polyethylene (density = 0.923) 89.2 parts Surface-treated titanium oxide 10.0 parts Ultramarine 0.8 part | 45.0 |
| Pulp Layer | Wood free paper (LBKP/NBKP = 1/1; density = 1.080) | 92.6 |
| Surface PE Layer (matted) | High density polyethylene (density = 0.960) | 36.0 |
| Surface Subbing Layer | Gelatin | 0.05 |
| | Colloidal silica | 0.05 |

TABLE 2-continued

Total = 173.8

*1) Silicone oil (13)

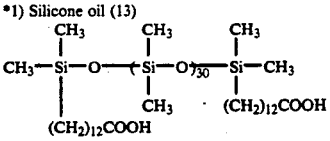

*2) Surfactant (14)

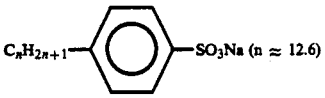

*3) Surfactant (15)

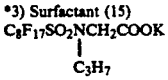

*4) Surfactant (16)

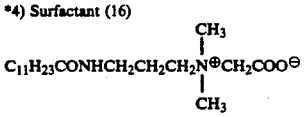

*5) Brightening agent (21) 2,5-Bis(5-tert-butylbenzoxazole (2))thiophene

*6) Surfactant (22)

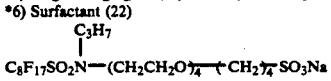

*7) Water-soluble polymer (17) Sumika Gel L5-H (produced by Sumitomo Chemical Co., Ltd.)

*8) Water-soluble polymer (19) Dextran (molecular weight: 70,000)

*9) Mordant (18)

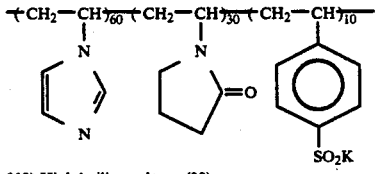

*10) High boiling solvent (20)

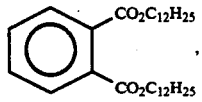

*11) Hardener (23)

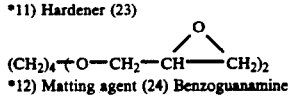

*12) Matting agent (24) Benzoguanamine resin (average particle size: 15μ)

Other Photosensitive Materials 102 to 110 were prepared in the same manner as Photosensitive Material 101, except that an additive including the compounds of this invention was further added to Photosensitive Material 101 in accordance with their respective formulae shown in Table 3.

TABLE 3

| Photo-sensitive Material No. | Additive | Layer added | Amount added (mg/m²) |
|---|---|---|---|
| 101 | — | — | — |
| 102 | Active Carbon | 2nd Layer | 50 |
| 103 | ditto | ditto | 100 |
| 104 | ditto | 4th Layer | 50 |
| 105 | $A_{11}B_8$* | 2nd Layer | 25 |
| 106 | ditto | 3rd Layer | 25 |
| 107 | ditto | 6th Layer | 25 |
| 108 | $A_{14}B_8$** | 2nd Layer | 25 |
| 109 | ditto | ditto | 50 |
| 110 | ditto | 4th Layer | 25 |

*prepared in accordance with [Preparation I].

**prepared in accordance with [Preparation II].

The dispersion of active carbon was prepared as follows: 2.5 g of active carbon powder (reagent special grade, produced by Wako Pure Chemical Industries, Ltd.), 1 g of a dispersant (Demol N, produced by Kao Corporation) and 0.25 g of polyethylene glycol nonylphenyl ether were added to 100 ml of a 5% aqueous solution of gelatin, and ground for 120 minutes with a mill utilizing glass beads having an average size of 0.75 mm. Then, the glass beads were separated therefrom, and a dispersion of active carbon having an average particle size of 0.5 μ was obtained.

Each of the thus prepared multilayer color Photosensitive Materials 101 to 110 was exposed for 1/10 sec. under illuminance of 5,000 lux by means of a tungsten lamp through B, G, R and gray separation filters with continuously changed density.

15 ml/m$^2$ of water was supplied to the emulsion face of each of the exposed photosensitive materials using a wire bar as each material was conveyed at a linear speed of 20 mm/sec. Immediately thereafter, the water-supplied face and the image-receiving material were superposed so as to be in face-to-face contact with each other.

The superposed materials were heated for 15 seconds with a heat roller the temperature of which was controlled so that a temperature of the water-absorbed layer might become 85° C., and then the photosensitive material was peeled apart from the image-receiving material. Thus, clear blue, green, red and gray images corresponding to B, G, R and gray separation filters, respectively, were obtained uniformly on the image-receiving material.

Maximum densities (Dmax) and minimum densities (Dmin) of cyan, magenta and yellow in the gray part were measured, and the results thereof are shown in Table 4.

TABLE 4

| Photosensitive Material No. | Dmax | | | Dmin | | |
|---|---|---|---|---|---|---|
| | Cyan | Magenta | Yellow | Cyan | Magenta | Yellow |
| 101 (comparison) | 2.18 | 2.26 | 2.20 | 0.17 | 0.19 | 0.19 |
| 102 (comparison) | 2.17 | 2.26 | 2.20 | 0.14 | 0.19 | 0.18 |
| 103 (comparison) | 2.02 | 2.15 | 2.03 | 0.12 | 0.18 | 0.18 |
| 104 (comparison) | 2.18 | 2.25 | 2.21 | 0.14 | 0.19 | 0.18 |
| 105 (invention) | 2.17 | 2.26 | 2.20 | 0.12 | 0.16 | 0.16 |
| 106 (invention) | 2.18 | 2.25 | 2.20 | 0.12 | 0.16 | 0.16 |
| 107 (invention) | 2.18 | 2.25 | 2.21 | 0.12, | 0.16 | 0.16 |
| 108 (invention) | 2.17 | 2.26 | 2.21 | 0.12 | 0.16 | 0.16 |
| 109 (invention) | 2.16 | 2.24 | 2.19 | 0.11 | 0.15 | 0.15 |
| 110 (invention) | 2.18 | 2.25 | 2.20 | 0.12 | 0.16 | 0.16 |

As can be seen form the data of Table 4, Photosensitive Materials 105 to 110, wherein the trapping agents of this invention were used respectively, produced such images that Dmin's of three colors, namely cyan, magenta and yellow, were each lowered without being attended by a considerable drop in their respective Dmax's, compared with Photosensitive Material 101.

EXAMPLE 2

Another multilayer color Photosensitive Material 201 was prepared using the same emulsions and dye-providing materials as used for preparation of the color photosensitive materials in Example 1, and the various ingredients set forth in the following Table 5.

TABLE 5

| Ordinal Number of Layer | Name of Layer | Ingredient | Coverage (mg/m$^2$) |
|---|---|---|---|
| 12th | Protective layer | Polymer (26) *1) | 900 |
| | | Tinuvin | 500 |
| | | Hardener (27) *2) | 26 |
| | | Gelatin | 1300 |
| | | Surfactant (6) | 30 |
| 11th | Blue-sensitive layer | Light-sensitive silver halide emulsion (I) | 500** |
| | | Gelatin | 1100 |
| | | Surfactant (6) | 25 |
| 10th | Yellow layer | Yellow dye-providing compound (1) | 500 |
| | | Electron donor (B) *5) | 275 |
| | | High boiling solvent (2) | 250 |
| | | Gelatin | 1100 |
| | | Surfactant (8) | 58 |
| | | Water-soluble polymer (12) | 8 |
| 9th | Interlayer | Electron donor (28) *3) | 820 |
| | | Vinyl acetate | 300 |
| | | Gelatin | 400 |
| | | Surfactant (6) | 20 |
| | | Water-soluble polymer (12) | 12 |
| 8th | Green-sensitive layer | Light-sensitive silver halide emulsion (II) | 500** |
| | | Gelatin | 1000 |
| | | Surfactant (5) | 25 |
| 7th | Magenta layer | Magenta dye-providing compound (2) | 370 |
| | | Electron donor (B) | 180 |
| | | High boiling solvent (2) | 185 |
| | | Gelatin | 1100 |
| | | Surfactant (8) | 36 |
| | | Water-soluble polymer (12) | 15 |
| 6th | Interlayer | Electron donor (28) | 820 |
| | | Vinyl acetate | 300 |
| | | Gelatin | 400 |
| | | Surfactant (6) | 20 |
| | | Water-soluble polymer (12) | 12 |
| 5th | Red-sensitive layer | Light-sensitive silver halide emulsion (III) | 500** |
| | | Gelatin | 1100 |
| | | Surfactant (6) | 25 |
| 4th | Cyan layer | Cyan dye-providing compound (3) | 460 |
| | | Electron donor (B) | 180 |
| | | High boiling solvent (2) | 230 |
| | | Gelatin | 1100 |
| | | Surfactant (8) | 42 |
| | | Water-soluble polymer (12) | 15 |
| 3rd | Light shielding layer | Carbon black | 2700 |
| | | Gelatin | 2700 |
| | | Surfactant (8) | 50 |
| 2nd | White reflecting layer | Titanium dioxide | 22000 |
| | | Gelatin | 2200 |
| | | Surfactant (8) | 40 |
| 1st | Dye-fixing layer | Polymer (29) *4) | 4000 |
| | | Gelatin | 4000 |

TABLE 5-continued

| Ordinal Number of Layer | Name of Layer | Ingredient | Coverage (mg/m²) |
|---|---|---|---|
| Support | 100 μm-thick polyethylene terephthalate film | | |

*1) Polymer (26)
Polyethylene acrylate latex
*2) Hardener (27)
Triacryloyl perhydrotriazine
*3) Electron donor (28)

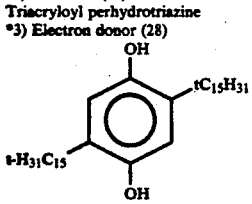

*4) Polymer (29)

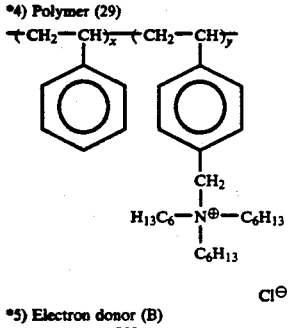

*5) Electron donor (B)

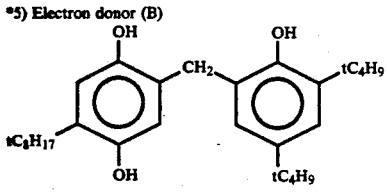

In the next place, preparation of a cover sheet was described below.

A cover sheet having the constitution described in Table 6 was prepared.

TABLE 6

| Constituent Layer | Name of Layer | Ingredient | Coverage (mg/m²) |
|---|---|---|---|
| 3rd layer | Timing layer | Polymer (30) *1) | 4000 |
| 2nd layer | Timing layer | Polymer (31) *2) | 2000 |
| 1st layer | Acid neutralizing layer | Polymer (32) *3) | 17000 |
| | | N-Hydroxysuccinimidobenzenesulfonate | 60 |
| | | Ethylene glycol | 500 |
| Support | 100 μm-thick polyethylene terephthalate film | | |

*1) Polymer (30)
Latex of $-(CH_2-CCl_2)_x-(CH_2-\underset{\underset{COOH}{|}}{CH})_y-$
*2) Polymer (31)
Cellulose acetate
*3) Polymer (32)
$-(CH_2-\underset{\underset{COOH}{|}}{CH})-$ Further, a processing solution having the following formula was prepared.

| | |
|---|---|
| Potassium hydroxide | 48 g |
| 4-Hydroxymethyl-4-methyl-p-tolyl-3-pyrazolidinone | 10 g |
| 5-Methylbenzotriazole | 1.5 g |
| Sodium sulfite | 1.5 g |
| Potassium bromide | 1 g |
| Benzyl alcohol | 1.5 ml |
| Carboxymethyl cellulose | 6.1 g |

-continued

| | |
|---|---|
| Carbon black | 150 g |
| Water to make | 1 l |

Other Photosensitive Materials 202 to 207, which have the same composition as Photosensitive Material 201, except that the trapping agents shown in Table 7 were added respectively, were prepared.

TABLE 7

| Photosensitive Material No. | Additive | Layer added | Amount added (mg/m²) |
|---|---|---|---|
| 201 | — | — | — |
| 202 | Alumina Sol | 12th Layer | 100 |
| 203 | Alumina Sol | 12th Layer | 300 |
| 204 | $A_{13}B_6$* | 12th Layer | 30 |
| 205 | $A_{13}B_6$* | 12th Layer | 60 |
| 206 | $A_{13}B_6$* | 9th Layer | 30 |
| 207 | Polymer C** | 12th Layer | 30 |

*used as $A_{13}$ the following polymer:

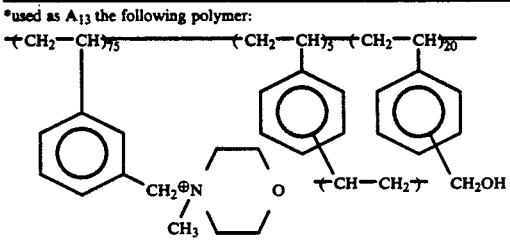

**Polymer C

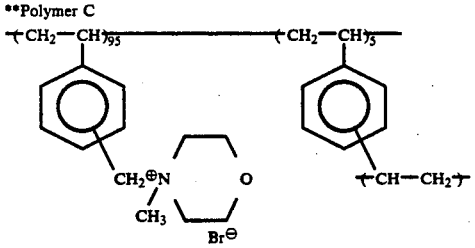

Each of color Photosensitive Materials 201 to 207 was exposed wedgewise in the same manner as in Example 1, and then the cover sheet was superposed thereon. Subsequently, the processing solution was spread uniformly in a layer 80 μ in thickness between the photosensitive material and the cover sheet using a pair of rollers. After a one-hour lapse from this treatment, the same sensitometry as in Example 1 was carried out. The results obtained are shown in Table 8.

TABLE 8

| Photosensitive Material No. | Dmax | | | Dmin | | |
|---|---|---|---|---|---|---|
| | Cyan | Magenta | Yellow | Cyan | Magenta | Yellow |
| 201 (comparison) | 2.10 | 2.15 | 2.01 | 0.19 | 0.23 | 0.23 |
| 202 (comparison) | 2.10 | 2.15 | 2.00 | 0.19 | 0.23 | 0.23 |
| 203 (comparison) | 2.06 | 2.10 | 1.97 | 0.18 | 0.23 | 0.22 |
| 204 (invention) | 2.10 | 2.16 | 2.02 | 0.15 | 0.18 | 0.19 |
| 205 (invention) | 2.08 | 2.14 | 2.00 | 0.14 | 0.17 | 0.18 |
| 206 (invention) | 2.10 | 2.16 | 2.01 | 0.15 | 0.18 | 0.19 |
| 207 (Comparison)** | — | — | — | — | — | — |

**Unevenness and spotted deposition were observed in the photosensitive material, so it was impossible to carry out the sensitometry.

As can be seen from the data of Table 8, in analogy with the result of Example 1, the photosensitive materials using the trapping agents of this invention respectively produced images excellent in discrimination. In addition, it has tuned out that it is impracticable to add a quaternary salt polymer whose counter anion is $Br^-$ as it is.

EXAMPLE 3

Preparation of Emulsion (IV) for the fifth and first layers is described below.

To a vigorously stirred aqueous gelatin solution (containing 20 g of gelatin and 3 g of sodium chloride in 1,000 ml of water, and kept at 75° C.), 600 ml of an aqueous solution containing sodium chloride and potassium bromide and an aqueous silver nitrate solution (containing 0.59 mole of silver nitrate dissolved in 600 ml of water) were added simultaneously over a 40-minute period at an equal flow rate. Thus, a monodisperse cubic silver chlorobromide emulsion (bromide content: 50 mol %, an average grain size: 0.40 μm) was obtained.

After washing and subsequent desalting steps, the obtained emulsion was chemically sensitized at 60° C. by the addition of 5 mg of sodium thiosulfate and 20 mg of 4-hydroxy6-methyl-1,3,3a,7-tetrazaindene. A yield of this emulsion was 600 g.

Next, preparation of Emulsion (V) for the third layer is described below.

To a vigorously stirred aqueous gelatin solution (containing 20 g of gelatin and 3 g of sodium chloride in 1,000 ml of water, and kept at 75° C.), 600 ml of an aqueous solution containing sodium chloride and potassium bromide and an aqueous silver nitrate solution (containing 0.59 mole of silver nitrate dissolved in 600 ml of water) were added simultaneously over a 40-minute period at an equal flow rate. Thus, a monodisperse cubic silver chlorobromide emulsion (bromide content: 80 mol %, an average grain size: 0.35 μm) was obtained.

After washing and subsequent desalting steps, the obtained emulsion was chemically sensitized at 60° C. by the addition of 5 mg of sodium thiosulfate and 20 mg of 4-hydroxy-6-methyl-1,3,3a,7-tetrazaindene. A yield of this emulsion was 600 g.

Then, preparation of a benzotriazole silver emulsion is described below.

28 g of gelatin and 13.2 g of benzotriazole were dissolved in 300 ml of water. The resulting solution was kept at 40° C., and stirred. Thereto, a solution containing 17 g of silver nitrate dissolved in 100 ml of water was added over a 2-minute period.

From the thus obtained benzotriazole silver emulsion, excess salt was removed by sedimentation through pH control. Thereafter, the pH of the emulsion was adjusted to 6.30. Thus, 400 g of a benzotriazole silver emulsion was obtained.

Further, preparation of an acetylene silver emulsion is described below.

20 g of gelatin and 4.6 g of 4-acetylaminophenylacetylene were dissolved in a mixture of 1000 ml of water with 200 ml of ethanol. The resulting solution was kept at 40° C., and stirred. Thereto, a solution containing 4.5 g of silver nitrate dissolved in 200 ml of water was added over a 5-minute period. From this dispersion, excess salt was removed by sedimentation through pH control. Thereafter, the pH of the dispersion was adjusted to 6.3. Thus, 300 g of an acetylene silver emulsion was obtained.

Furthermore, gelatin dispersions of dye-providing materials were prepared in the following manners.

5 g of an yellow dye-providing material (4)*, 0.2 g of an auxiliary developer (37), 0.2 g of an antifoggant (38), 0.5 g of sodium 2-ethylhexylsuccinosulfonate (as a surfactant) and 2.5 g of triisononyl phosphate were weighed out, and thereto was added 30 ml of ethyl acetate. The resulting mixture was heated up to about 60° C. to make a homogeneous solution. This solution was mixed with 100 g of a 3% solution of lime-processed gelatin with stirring, and then mechanically dispersed for 10 minutes with a homogenizer rotating at 10,000 rpm. Thus, a dispersion of the yellow dye-providing material was obtained.

Auxiliary Developer (37)

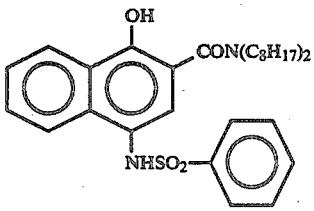

Antifoggant (38)

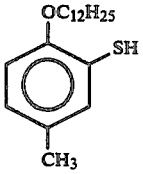

Dye-providing Material (4)*

-continued

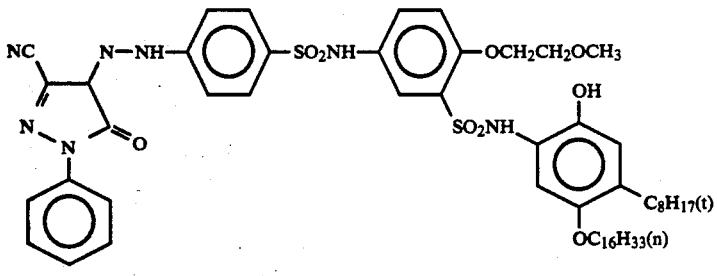

Dye-providing Material (5)*

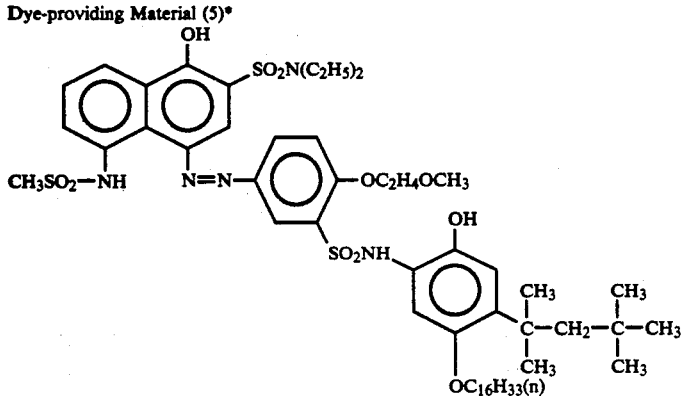

Dye-providing Material (6)*

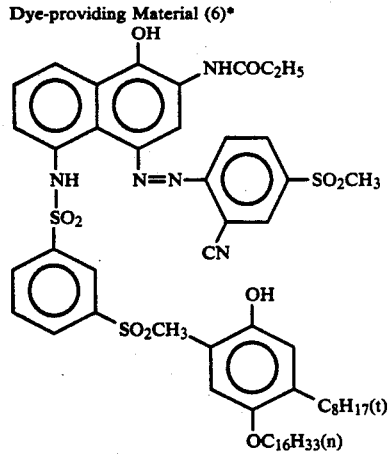

A dispersion of a magenta dye-providing material was prepared in the same manner as described above, except that the magenta dye-providing material (5)* was used in the place of the yellow dye-providing material (4)* and 2.5 g of tri-cresyl phosphate was used as a high boiling solvent.

Also, a dispersion of a cyan dye-providing material was prepared in the same manner as that of the yellow dye-providing material, except that the cyan dye-providing material (6)* was used in the place of the yellow dye-providing material (4)*.

Using the above-described emulsions and dispersions, multilayer heat-developable Photosensitive Material 301 was prepared in accordance with the formula described in Table 9.

TABLE 9

| Ordinal Number of Layer | Name of Layer | Ingredient | Coverage (mg/m$^2$) |
|---|---|---|---|
| 6th | Protective layer | Gelatin | 900 |
| | | Water-soluble polymer (17) | 230 |

TABLE 9-continued

| | | | |
|---|---|---|---|
| | | Matting agent (Silica) | 30 |
| | | Surfactant (5) | 110 |
| | | Surfactant (6) | 62 |
| | | Surfactant (33) *1) | 36 |
| | | Hardener (10) | 36 |
| 5th | Green-sensitive emulsion layer | Gelatin | 440 |
| | | Light-sensitive silver halide emulsion (IV) | 270** |
| | | Sensitizing dye (34) *2) | 0.8 |
| | | Antifoggant (35) *3) | 4 |
| | | Yellow dye-providing compound (4)* | 300 |
| | | High boiling solvent (36) *4) | 150 |
| | | Auxiliary developer (37) | 24 |
| | | Antifoggant (38) | 6 |
| | | Surfactant (7) | 33 |
| | | Water-soluble polymer (12) | 7 |
| | | Antifoggant (41) *5) | 16 |
| 4th | Interlayer | Gelatin | 560 |
| | | Zinc hydroxide | 240 |
| | | Surfactant (8) | 48 |
| | | Antifoggant (35) | 6 |
| | | Surfactant (6) | 10 |

TABLE 9-continued

| | | | |
|---|---|---|---|
| | | Water-soluble polymer (12) | 12 |
| 3rd | Red-sensitive emulsion layer | Gelatin | 310 |
| | | Light-sensitive silver halide emulsion (V) | 77** |
| | | Benzotriazole silver emulsion | 3** |
| | | Acetylene silver emulsion | 110** |
| | | Sensitizing dye (39) *6) | 0.05 |
| | | Magenta dye-providing compound (5)* | 240 |
| | | High boiling solvent (40) *7) | 60 |
| | | Surfactant (8) | 24 |
| | | Surfactant (7) | 26 |
| | | Auxiliary developer (37) | 10 |
| | | Antifoggant (38) | 3 |
| | | Antifoggant (41) | 12 |
| | | Water-soluble polymer (12) | 8 |
| 2nd | Interlayer | Gelatin | 620 |
| | | Zinc hydroxide | 190 |
| | | Surfactant (42) *8) | 56 |
| | | Surfactant (8) | 3 |
| | | Surfactant (6) | 6 |
| | | Water-soluble polymer (12) | 5 |
| 1st | Infrared-sensitive emulsion layer | Gelatin | 420 |
| | | Light-sensitive silver halide emulsion (IV) | 140** |
| | | Benzotriazole silver emulsion | 26** |
| | | Acetylene silver emulsion | 114** |
| | | Sensitizing dye (43) *9) | 0.02 |
| | | Antifoggant (44) *10) | 0.5 |
| | | Cyan dye-providing compound (6)* | 290 |
| | | High boiling solvent (36) | 160 |
| | | Auxiliary developer (37) | 15 |
| | | Antifoggant (38) | 12 |
| | | Surfactant (7) | 32 |
| | | Water-soluble polymer (12) | 11 |
| Support | 96 μm-thick polyethylene terephthalate film | | |
| | Backing layer | Carbon black | 440 |
| | | Polyvinyl chloride | 300 |

**coverage based on silver.

*1) Surfactant (33)

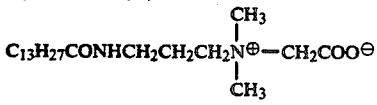

*2) Sensitizing dye (34)

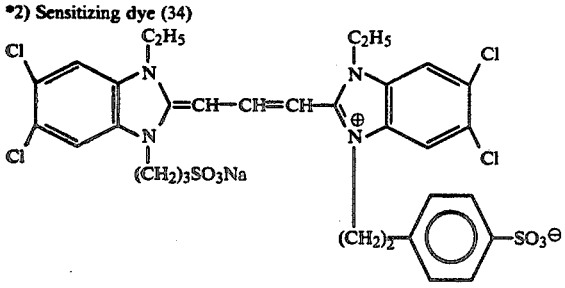

*3) Antifoggant (35)

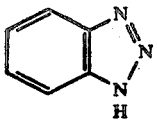

*4) High boiling solvent (36)
(iso $C_9H_{19}O)_3P{=}O$

*5) Antifoggant (41)

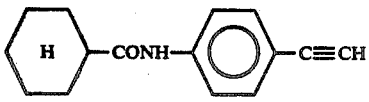

*6) Sensitizing dye (39)

TABLE 9-continued

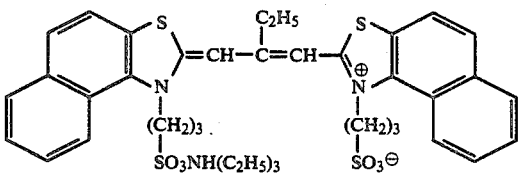

*7) High boiling solvent (40)

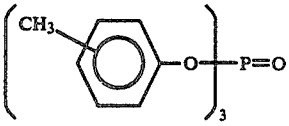

*8) Surfactant (42)

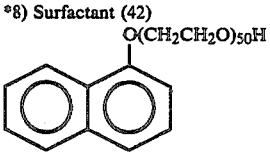

*9) Sensitizing dye (43)

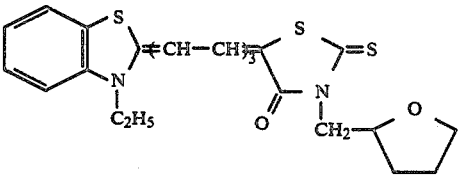

*10) Antifoggant (44)

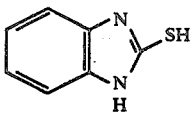

Next, Photosensitive Materials 302 to 305 which had the same constitution as that of Photosensitive Material 301, except that an additive was added or a trapping layer was provided as shown in Table 10, were prepared.

TABLE 10

| Photo-sensitive Material | Additive | Layer added | Amount added* | Dry thickness (μm) |
|---|---|---|---|---|
| 301 | — | — | — | 6.5 |
| 302 | Polymer D** | UL layer | 5% | 11.5 |
| 303 | Polymer D** | UL layer | 5% | 16.5 |
| 304 | $A_{13}B_6$*** | 2nd layer | 5% | 6.5 |
| 305 | $A_{13}B_6$*** | 4th layer | 5% | 6.5 |

*mol % of the yellow color material to the quaternary salt moiety.
**Polymer D

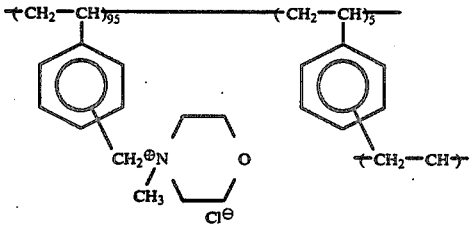

***the same as used in Example 2. provided between the support and the 1st layer, and constituted by gelatin (4500 mg/m² in Photosensitive Material 302, and 9000 mg/m² in Photosensitive Material 303) and Polymer D.

Each of the thus prepared Photosensitive Materials 301 to 305 was exposed for 1 second under illuminance of 500 lux by means of a tungsten lamp through G, R and IR separation filters with continuously changed density (G: a 500–600 nm band pass filter, R: a 600–700 nm band pass filter, IR: a filter transmitting light of wavelengths longer than 700 nm).

12 ml/m$^2$ of water was supplied to the emulsion face of each of the exposed heat developable photosensitive materials using a wire bar, and then the water-supplied face and Image-Receiving Material R-1 were superposed so as to be in face-to-face contact with each other.

The superposed materials were heated for 30 seconds with a heat roller the temperature of which was controlled so that a temperature of the water-absorbed layer might become 93° C., and then the photosensitive material was peeled apart from the dye-fixing material. Thus, clear yellow, magenta and cyan images corresponding to G, R and IR separation filters, respectively, were obtained on the dye-fixing material.

Maximum density (Dmax) and minimum density (Dmin) of each color were measured, and the results thereof are shown in Table 11.

TABLE 11

| Photosensitive Material No. | Dmax | | | Dmin | | |
|---|---|---|---|---|---|---|
| | Cyan | Magenta | Yellow | Cyan | Magenta | Yellow |
| 301 (comparison) | 2.35 | 2.10 | 2.05 | 0.12 | 0.16 | 0.15 |
| 302 (comparison) | 1.90 | 1.64 | 1.45 | 0.09 | 0.14 | 0.12 |
| 303 (comparison) | 1.35 | 1.20 | 1.11 | 0.08 | 0.13 | 0.11 |
| 304 (Invention) | 2.34 | 2.10 | 2.06 | 0.09 | 0.14 | 0.12 |
| 305 (Invention) | 2.35 | 2.09 | 2.05 | 0.09 | 0.14 | 0.12 |

As can be seen from the data of Table 11, Photosensitive Materials 302 and 303, which each was provided with the subbing layer, though had a trapping effect, produced a remarkable drop in Dmax. In contrast to such materials, Photosensitive Materials 304 and 305 which used the trapping agent of this invention produced images of low Dmin without lowering Dmax.

Next, another Image-Receiving Material R-2 was made in the same manner as Image-Receiving Material R-1, except that the mordant (18) was replaced by the following mordant E.

Mordant E:

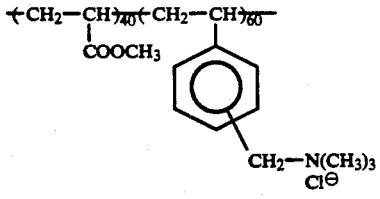

Each of Photosensitive Materials 301 to 305 was used in combination with Image-Receiving Material R-2, and subjected to the same processing as described above. The thus obtained data on Dmax and Dmin are shown in Table 12.

TABLE 12

| Photosensitive Material No. | Dmax | | | Dmin | | |
|---|---|---|---|---|---|---|
| | Cyan | Magenta | Yellow | Cyan | Magenta | Yellow |
| 301 | 2.40 | 2.16 | 2.10 | 0.13 | 0.17 | 0.15 |
| 302 | 1.97 | 1.70 | 1.52 | 0.12 | 0.16 | 0.14 |
| 303 | 1.49 | 1.30 | 1.16 | 0.11 | 0.15 | 0.13 |
| 304 | 2.41 | 2.17 | 2.10 | 0.12 | 0.16 | 0.14 |

TABLE 12-continued

| Photosensitive Material No. | Dmax | | | Dmin | | |
|---|---|---|---|---|---|---|
| | Cyan | Magenta | Yellow | Cyan | Magenta | Yellow |
| 305 | 2.40 | 2.16 | 2.11 | 0.12 | 0.16 | 0.14 |

Comparing the data of Table 11 with those of Table 12, it has turned out that the trapping agent of this invention can achieve its effect more remarkably in Image-Receiving Material R-1 using a tertiary amine mordant (shown in Table 11) than in Image-Receiving Material R-2 using a quaternary amine mordant (shown in Table-12).

While the invention has been described in detail and with reference to specific embodiments thereof, it will be apparent to one skilled in the art that various changes and modifications can be maded therein without departing from the spirit and scope thereof.

What is claimed is:

1. A diffusion transfer color photosensitive material comprising a support having thereon at least light-sensitive silver halides, binders and nondiffusible dye-providing compounds capable of releasing or forming a diffusible dye, corresponding to or counter-corresponding to the progress of conversion of the silver halides into silver through reductive reaction, said material further containing at least one compound represented by the following formula (I):

$$-(A)_p-(B)_q- \quad (I)$$

wherein A represents at least one vinyl monomer unit containing a quaternary ammonia ion having associated therewith a counter ion at least 50 mol % of which is constituted by an anion represented by the following formula (II):

$$R-X^- \quad (II)$$

wherein $X^-$ represents $SO_3^-$ and/or $COO^-$, and R contains at least 10 carbon atoms and represents a substituted or unsubstituted alkyl, aryl, alkoxy, aryloxy or heterocyclyl group; B represents at least one vinyl monomer unit containing no quaternary ammonium salt moiety; p amounts to 2 to 100 mol % in all; and q amounts to 0 to 98 mol % in all.

2. The diffusion transfer color photosensitive material of claim 1, wherein said photosensitive material has a dry thickness of 15 μm or less and is processed at a temperature ranging from about 50° C. to 250° C.

3. A system for forming color images by dye diffusion transfer comprising the combination of a diffusion transfer color photosensitive material comprising a support having thereon at least light-sensitive silver halides, binders and nondiffusible dye-providing compounds capable of releasing or forming a diffusible dye, corresponding to or counter-corresponding to the progress of conversion of the silver halides into silver through reductive reaction, said material further containing at least one compound represented by the following formula (I):

$$-(A)_p-(B)_q- \quad (I)$$

wherein A represents at least one vinyl monomer unit containing a quaternary ammonium ion having associated therewith a counter ion at least 50 mol % of which is constituted by an anion represented by the following formula (II):

$$R-X^- \quad (II)$$

wherein $X^-$ represents $SO_3^-$ and/or $COO^-$, and R contains at least 10 carbon atoms and represents a substituted or unsubstituted alkyl, aryl, alkoxy, aryloxy or heterocyclyl group; B represents at least one vinyl monomer unit containing no quaternary ammonium salt moiety; p amounts to 2 to 100 mol % in all; and q amounts to 0 to 98 mol % in all, and a dye-fixing material comprising an image-receiving layer which includes a polymer mordant comprising tertiary nitrogen-containing vinyl monomer units.

* * * * *